US009151561B2

(12) United States Patent
Morrow et al.

(10) Patent No.: US 9,151,561 B2
(45) Date of Patent: Oct. 6, 2015

(54) SHOOTING RESTS FOR SUPPORTING FIREARMS

(71) Applicant: Battenfeld Technologies, Inc., Columbia, MO (US)

(72) Inventors: Tim Morrow, Jefferson City, MO (US); Larry Potterfield, Columbia, MO (US); Russell A. Potterfield, Columbia, MO (US); Robert Joseph Zara, Rocheport, MO (US); Dennis Cauley, Boonville, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 14/146,960

(22) Filed: Jan. 3, 2014

(65) Prior Publication Data

US 2014/0115941 A1 May 1, 2014

Related U.S. Application Data

(60) Division of application No. 11/431,956, filed on May 10, 2006, now Pat. No. 8,621,773, which is a continuation-in-part of application No. 10/865,595, filed on Jun. 10, 2004, now Pat. No. 8,011,129.

(60) Provisional application No. 60/478,557, filed on Jun. 13, 2003.

(51) Int. Cl.

| | |
|---|---|
| ***F41A 23/16*** | (2006.01) |
| ***F41A 31/00*** | (2006.01) |
| ***F41A 23/02*** | (2006.01) |

(52) U.S. Cl.

CPC ..... *F41A 23/02* (2013.01); *F41A 23/16* (2013.01)

(58) Field of Classification Search

CPC ..... F41A 31/00; F41A 31/02; F41A 23/00; F41A 23/02; F41A 23/16; A01M 31/02

USPC ..... 42/94, 90; 73/167; 89/37.04, 40.06

See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |

(Continued)

FOREIGN PATENT DOCUMENTS

| | | |
|---|---|---|
| DE | 838872 | 5/1952 |
| EP | 0624455 | 11/1994 |
| GB | 475080 | 11/1937 |

OTHER PUBLICATIONS

"American Rifleman: What to do about recoil," LookSmart, http ://www.findarticles.com/p/articles/mi_qa3623/is_199907/ai_n886159/print, pp. 1-4, accessed Jan. 4, 2006.

(Continued)

*Primary Examiner* — Jonathan C Weber

(74) *Attorney, Agent, or Firm* — Senniger Powers LLP

(57) ABSTRACT

One aspect of the invention is directed to shooting rests for supporting a firearm having a first portion and a second portion rearward of the first portion. In one embodiment, a shooting rest includes a frame, a front support for supporting the first portion of the firearm, a support member for carrying one or more weights, and a stop for inhibiting rearward movement of the firearm relative to the shooting rest. The front support is coupled to the frame, and the support member is positioned at least proximate to the frame. The stop includes a flexible portion and is also coupled to the frame.

8 Claims, 11 Drawing Sheets

(56) References Cited

U.S. PATENT DOCUMENTS

| | | | |
|---|---|---|---|
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,187,325 | A | 6/1916 | Ivey |
| 1,195,777 | A | 8/1916 | Burtin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |
| 1,499,748 | A | 5/1922 | Papouchis |
| 1,457,407 | A | 6/1923 | Stokes |
| 1,488,647 | A | 4/1924 | Quinn |
| 1,491,604 | A | 4/1924 | Fuller |
| 1,639,722 | A | 8/1927 | Whitney |
| 1,693,289 | A | 11/1928 | Warren |
| 1,736,244 | A | 11/1929 | Baker |
| 1,902,040 | A | 3/1933 | Meyer |
| 1,907,181 | A | 5/1933 | Fey |
| 1,927,876 | A | 9/1933 | Meyer |
| 1,928,871 | A | 10/1933 | Swebilius |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,427,365 | A | 3/1944 | Meister |
| 2,378,545 | A | 6/1945 | Fraser et al. |
| D147,305 | S | 8/1947 | Sloan |
| 2,432,519 | A | 12/1947 | Garand |
| 2,451,266 | A | 10/1948 | Whittemore |
| 2,455,644 | A | 12/1948 | Barnes |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,582,140 | A | 1/1952 | Leek |
| 2,638,676 | A | 5/1953 | Callahan |
| 2,677,207 | A | 5/1954 | Stewart |
| 2,701,930 | A | 2/1955 | Dolan |
| 2,729,975 | A | 1/1956 | Hawthornet et al. |
| 2,731,829 | A | 1/1956 | Wigington et al. |
| 2,740,530 | A | 4/1956 | Ponder |
| 2,753,642 | A | 7/1956 | Sullivan |
| 2,774,090 | A | 12/1956 | Allinson |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 2,847,909 | A | 8/1958 | Kester |
| 2,867,931 | A | 1/1959 | Schreiber |
| 2,874,707 | A | 2/1959 | Koppel |
| 2,877,689 | A | 3/1959 | Pribis |
| 2,894,347 | A | 7/1959 | Woodcock |
| 3,064,976 | A | 11/1959 | Kuhn |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,013,289 | A | 12/1961 | Sasena |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,107,642 | A | 10/1963 | Lakin |
| 3,112,567 | A | 12/1963 | Flanagan |
| 3,125,929 | A | 3/1964 | Peasley |
| 3,128,668 | A | 4/1964 | Dicken |
| 3,137,957 | A | 6/1964 | Ingalls |
| 3,163,420 | A | 12/1964 | Braun |
| 3,175,456 | A | 3/1965 | Goodsell |
| 3,183,617 | A | 5/1965 | Ruger et al. |
| 3,205,518 | A | 9/1965 | Romaine |
| 3,206,885 | A | 9/1965 | Dye |
| 3,225,656 | A | 12/1965 | Flaherty et al. |
| D203,680 | S | 2/1966 | Allison |
| 3,240,103 | A | 3/1966 | Lamont |
| 3,259,986 | A | 7/1966 | Carr |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr. |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,473,673 | A | 10/1969 | Porter |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,536,160 | A | 10/1970 | Brewer |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,609,902 | A | 10/1971 | Casull |
| 3,646,704 | A | 3/1972 | Ellsworth |
| 3,648,909 | A | 3/1972 | Wisecarver |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,736,243 | A | 5/1973 | Duggan |
| 3,738,101 | A | 6/1973 | Simon-Vermot |
| 3,739,515 | A | 6/1973 | Koon, Jr. |
| 3,743,088 | A | 7/1973 | Henkin |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |
| 3,771,176 | A | 11/1973 | Herman, Sr. |
| 3,804,238 | A | 4/1974 | Howard |
| 3,813,816 | A | 6/1974 | Funk |
| 3,815,270 | A | 6/1974 | Pachmayr |
| 3,826,559 | A | 7/1974 | Berliner et al. |
| 3,827,172 | A | 8/1974 | Howe |
| 3,842,527 | A | 10/1974 | Low |

(56) References Cited

U.S. PATENT DOCUMENTS

| | | | | | |
|---|---|---|---|---|---|
| D233,853 | S | | 12/1974 | Ferrara | |
| 3,876,078 | A | | 4/1975 | Gomes et al. | |
| 3,877,178 | A | | 4/1975 | Campanelli | |
| 3,878,939 | A | | 4/1975 | Wilcox | |
| 3,885,357 | A | | 5/1975 | Hoyt | |
| 3,893,266 | A | | 7/1975 | Anderson et al. | |
| 3,895,803 | A | | 7/1975 | Loe | |
| 3,899,175 | A | | 8/1975 | Loe | |
| 3,899,797 | A | | 8/1975 | Gunst | |
| D237,106 | S | | 10/1975 | Baljet et al. | |
| 3,913,746 | A | | 10/1975 | Burton | |
| 3,914,879 | A | | 10/1975 | Taylor, III et al. | |
| 3,935,657 | A | | 2/1976 | Wade | |
| 3,947,988 | A | | 4/1976 | Besaw | |
| 3,949,987 | A | | 4/1976 | Candor | |
| 3,961,436 | A | | 6/1976 | Hagen et al. | |
| 3,964,613 | A | | 6/1976 | Anderson, Jr. | |
| 3,979,849 | A | | 9/1976 | Haskins | |
| 3,358,504 | A | | 12/1976 | Freebaim | |
| 4,007,554 | A | * | 2/1977 | Helmstadter | 42/94 |
| 4,012,860 | A | | 3/1977 | Auger | |
| 4,018,339 | A | * | 4/1977 | Pritz | 211/8 |
| 4,021,971 | A | | 5/1977 | McFadden | |
| 4,026,057 | A | | 5/1977 | Cady | |
| 4,027,781 | A | | 6/1977 | Covert | |
| 4,042,242 | A | | 8/1977 | Nicholls et al. | |
| 4,054,288 | A | | 10/1977 | Perrine, Sr. | |
| 4,055,016 | A | | 10/1977 | Katsenes | |
| 4,072,313 | A | | 2/1978 | Murso et al. | |
| 4,076,247 | A | | 2/1978 | Kim et al. | |
| 4,090,606 | A | | 5/1978 | Dawson | |
| 4,120,108 | A | | 10/1978 | Vickers et al. | |
| 4,120,276 | A | | 10/1978 | Curran | |
| 4,122,623 | A | | 10/1978 | Stice | |
| 4,143,491 | A | | 3/1979 | Blanc | |
| 4,177,608 | A | | 12/1979 | Balz | |
| 4,188,855 | A | | 2/1980 | Alberts | |
| 4,203,600 | A | | 5/1980 | Brown | |
| 4,206,573 | A | | 6/1980 | Hayward | |
| 4,207,699 | A | * | 6/1980 | Hensley | 42/94 |
| 4,222,305 | A | | 9/1980 | Lee | |
| 4,223,588 | A | | 9/1980 | Simpson | |
| 4,233,748 | A | | 11/1980 | Ford et al. | |
| D257,687 | S | | 12/1980 | Bechtel | |
| 4,265,045 | A | | 5/1981 | Garbini | |
| 4,266,748 | A | | 5/1981 | Dalton | |
| 4,266,780 | A | | 5/1981 | McQuary | |
| 4,282,671 | A | | 8/1981 | Wood et al. | |
| D260,650 | S | | 9/1981 | Alviti | |
| D261,794 | S | | 11/1981 | Bechtel | |
| 4,301,625 | A | | 11/1981 | Rampe | |
| 4,312,146 | A | | 1/1982 | Koon, Jr. et al. | |
| 4,332,185 | A | | 6/1982 | Hargrove | |
| 4,333,385 | A | * | 6/1982 | Culver | 89/37.04 |
| 4,338,726 | A | | 7/1982 | Swailes | |
| 4,340,370 | A | | 7/1982 | Marshall et al. | |
| 4,345,398 | A | | 8/1982 | Pickett | |
| 4,346,530 | A | | 8/1982 | Stewart et al. | |
| 4,359,833 | A | | 11/1982 | Pachmayr et al. | |
| 4,361,989 | A | | 12/1982 | Ohno | |
| 4,385,464 | A | | 5/1983 | Casull | |
| 4,385,545 | A | | 5/1983 | Duer | |
| 4,391,058 | A | | 7/1983 | Casull | |
| 4,392,321 | A | | 7/1983 | Bosworth | |
| 4,407,379 | A | | 10/1983 | Pryor et al. | |
| 4,409,751 | A | | 10/1983 | Goda et al. | |
| 4,409,826 | A | | 10/1983 | Wenger | |
| 4,426,085 | A | | 1/1984 | Dixon | |
| 4,438,913 | A | | 3/1984 | Hylla | |
| 4,446,900 | A | | 5/1984 | Markovich | |
| 4,449,314 | A | | 5/1984 | Sorensen | |
| 4,462,598 | A | | 7/1984 | Chalin et al. | |
| 4,477,082 | A | | 10/1984 | McKenzie et al. | |
| 4,480,411 | A | | 11/1984 | Blaz et al. | |
| 4,506,466 | A | | 3/1985 | Hall | |
| 4,508,508 | A | | 4/1985 | Theodore | |
| 4,512,101 | A | | 4/1985 | Waterman, Jr. | |
| 4,522,102 | A | | 6/1985 | Pickens | |
| 4,526,084 | A | | 7/1985 | David et al. | |
| 4,540,182 | A | | 9/1985 | Clement | |
| 4,542,677 | A | | 9/1985 | Lee | |
| 4,548,392 | A | | 10/1985 | Rickling | |
| 4,558,531 | A | | 12/1985 | Kilby | |
| D283,561 | S | | 4/1986 | Geist et al. | |
| 4,601,124 | A | | 7/1986 | Brown, Jr. | |
| 4,608,762 | A | | 9/1986 | Varner | |
| 4,621,563 | A | | 11/1986 | Poiencot | |
| 4,625,620 | A | | 12/1986 | Harris | |
| 4,632,008 | A | | 12/1986 | Homer | |
| 4,644,987 | A | | 2/1987 | Kiang et al. | |
| 4,648,191 | A | | 3/1987 | Goff et al. | |
| 4,653,210 | A | | 3/1987 | Poff, Jr. | |
| 4,671,364 | A | | 6/1987 | Fink et al. | |
| 4,674,216 | A | | 6/1987 | Ruger et al. | |
| 4,695,060 | A | | 9/1987 | Pilgrim | |
| 4,696,356 | A | | 9/1987 | Ellion et al. | |
| 4,702,029 | A | | 10/1987 | DeVaul et al. | |
| 4,715,476 | A | | 12/1987 | France | |
| 4,715,499 | A | | 12/1987 | Franklin | |
| 4,716,673 | A | | 1/1988 | Williams et al. | |
| 4,721,205 | A | | 1/1988 | Burt et al. | |
| 4,723,472 | A | | 2/1988 | Lee | |
| 4,729,186 | A | | 3/1988 | Rieger | |
| 4,732,394 | A | | 3/1988 | Stein et al. | |
| 4,736,843 | A | | 4/1988 | Leonard | |
| 4,739,996 | A | | 4/1988 | Vedder | |
| 4,751,963 | A | | 6/1988 | Bui et al. | |
| D297,855 | S | | 9/1988 | Ruger et al. | |
| 4,776,471 | A | | 10/1988 | Elkins | |
| 4,790,079 | A | | 12/1988 | Meyers | |
| 4,790,096 | A | | 12/1988 | Gibson et al. | |
| 4,799,324 | A | | 1/1989 | Nodo | |
| 4,807,381 | A | | 2/1989 | Southard | |
| 4,807,888 | A | | 2/1989 | Pidde et al. | |
| 4,815,593 | A | | 3/1989 | Brown | |
| 4,819,359 | A | | 4/1989 | Bassett | |
| 4,821,422 | A | | 4/1989 | Porter | |
| 4,821,443 | A | | 4/1989 | Bianco | |
| 4,823,673 | A | | 4/1989 | Downing | |
| 4,824,086 | A | | 4/1989 | Rickling et al. | |
| 4,841,839 | A | | 6/1989 | Stuart | |
| 4,850,151 | A | | 7/1989 | Ditscherlein | |
| 4,854,066 | A | | 8/1989 | Canterbury, Sr. | |
| 4,862,567 | A | | 9/1989 | Beebe | |
| D304,223 | S | | 10/1989 | Ruger et al. | |
| 4,873,777 | A | | 10/1989 | Southard | |
| 4,877,131 | A | | 10/1989 | Patros et al. | |
| 4,890,406 | A | | 1/1990 | French | |
| 4,890,847 | A | | 1/1990 | Cartee et al. | |
| 4,896,446 | A | | 1/1990 | Gregory | |
| D306,234 | S | | 2/1990 | Ferstl et al. | |
| 4,903,425 | A | | 2/1990 | Harris | |
| 4,910,904 | A | | 3/1990 | Rose | |
| 4,918,825 | A | | 4/1990 | Lesh et al. | |
| 4,921,256 | A | | 5/1990 | Gearhart | |
| 4,923,402 | A | | 5/1990 | Marshall et al. | |
| 4,924,616 | A | * | 5/1990 | Bell | 42/94 |
| 4,937,965 | A | | 7/1990 | Narvaez | |
| D310,302 | S | | 9/1990 | Southard | |
| 4,967,497 | A | | 11/1990 | Yakscoe | |
| 4,971,208 | A | | 11/1990 | Reinfried, Jr. et al. | |
| 4,972,619 | A | * | 11/1990 | Eckert | 42/94 |
| 4,979,752 | A | | 12/1990 | Fosseen | |
| D313,886 | S | | 1/1991 | Southard | |
| 4,987,694 | A | | 1/1991 | Lombardo | |
| 4,998,367 | A | | 3/1991 | Leibowitz | |
| 4,998,944 | A | | 3/1991 | Lund | |
| 5,005,657 | A | | 4/1991 | Ellion et al. | |
| 5,009,021 | A | | 4/1991 | Nelson | |
| 5,014,793 | A | | 5/1991 | Germanton et al. | |
| 5,031,348 | A | | 7/1991 | Carey | |
| 5,050,330 | A | | 9/1991 | Pilgrim et al. | |
| 5,058,302 | A | | 10/1991 | Minneman | |
| 5,060,410 | A | | 10/1991 | Mueller | |

(56) References Cited

U.S. PATENT DOCUMENTS 5,063,679 A 11/1991 Schwandt
5,067,268 A 11/1991 Ransom
5,070,636 A * 12/1991 Mueller ..... 42/94
5,074,188 A 12/1991 Harris
5,081,783 A * 1/1992 Jarvis ..... 42/94
5,117,850 A 6/1992 Money
5,123,194 A 6/1992 Mason
5,125,389 A 6/1992 Paff
5,143,340 A 9/1992 Wood et al.
5,149,900 A 9/1992 Buck
5,173,563 A 12/1992 Gray
5,180,874 A 1/1993 Troncoso, Jr
5,185,927 A 2/1993 Rivers
5,186,468 A 2/1993 Davies
5,188,371 A 2/1993 Edwards
5,194,678 A 3/1993 Kramer
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,232,227 A 8/1993 Bateman
5,233,779 A 8/1993 Shaw
5,235,764 A 8/1993 Perazzi
5,237,778 A 8/1993 Baer
5,240,258 A 8/1993 Bateman
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,320,217 A 6/1994 Lenarz
5,320,223 A 6/1994 Allen
5,328,029 A 7/1994 Chow et al.
5,332,185 A 7/1994 Walker, III
5,333,829 A 8/1994 Bell et al.
5,335,578 A 8/1994 Lorden et al.
5,337,505 A 8/1994 Brown et al.
5,344,012 A 9/1994 Matthews
5,347,740 A 9/1994 Rather et al.
5,351,428 A 10/1994 Graham
5,354,247 A 10/1994 Wilkinson
5,358,254 A 10/1994 Yeh
5,361,505 A 11/1994 Faughn
5,367,232 A 11/1994 Netherton et al.
5,370,240 A 12/1994 Hand
5,375,377 A 12/1994 Kenton
5,392,553 A 2/1995 Carey
5,394,983 A 3/1995 Latulippe et al.
5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,433,451 A 7/1995 DeVries
5,435,223 A 7/1995 Blodgett et al.
5,442,860 A 8/1995 Palmer
D362,116 S 9/1995 Bellington et al.
5,446,987 A 9/1995 Lee et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,525,314 A 6/1996 Hurson
5,540,329 A 7/1996 Vogeley
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,588,242 A 12/1996 Hughes
5,600,913 A 2/1997 Minneman
5,617,666 A 4/1997 Scott
5,622,344 A 4/1997 Gracie
5,628,135 A 5/1997 Cady
D380,116 S 6/1997 Minneman
5,640,944 A 6/1997 Minneman
5,644,862 A 7/1997 Folmer
5,649,465 A 7/1997 Beebe
5,651,207 A 7/1997 Knight
5,653,625 A 8/1997 Pierce et al.
5,661,919 A 9/1997 Pryor
5,662,516 A 9/1997 You
5,666,757 A * 9/1997 Helmstadter ..... 42/94
D387,123 S 12/1997 Hughes et al.
5,703,317 A 12/1997 Levilly et al.
5,704,482 A 1/1998 Apps et al.
5,711,102 A 1/1998 Plaster et al.
5,711,103 A 1/1998 Keng
5,715,625 A 2/1998 West, III
D391,616 S 3/1998 Plybon
5,723,183 A 3/1998 Williams et al.
5,723,806 A 3/1998 Odom
5,725,096 A 3/1998 Winnard
5,737,865 A 4/1998 Brandl et al.
5,740,625 A 4/1998 Jenkins
5,743,395 A 4/1998 Backer
5,758,447 A 6/1998 Venetz
5,758,933 A 6/1998 Clendening
5,761,954 A 6/1998 Dvorak
5,778,589 A 7/1998 Teague
5,779,527 A 7/1998 Maebashi
5,791,499 A 8/1998 Zebbedies
5,811,720 A 9/1998 Quinnell et al.
5,815,974 A 10/1998 Keng
5,833,308 A 11/1998 Strong, III et al.
D403,176 S 12/1998 Harper
5,845,774 A 12/1998 Hausknecht
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,131 A 6/1999 Hossain et al.
5,913,422 A 6/1999 Cote et al.
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,937,561 A 8/1999 Abernethy
5,959,613 A 9/1999 Rosenbreg et al.
5,970,642 A 10/1999 Martin
5,974,719 A 11/1999 Simonek
6,019,375 A 2/2000 West, Jr.
6,021,891 A 2/2000 Anderson
6,032,796 A 3/2000 Hopper et al.
6,042,080 A 3/2000 Shepherd et al.
6,044,747 A 4/2000 Felts
6,058,641 A 5/2000 Vecqueray
6,073,381 A 6/2000 Farrar et al.
6,086,375 A 7/2000 Legros
6,092,662 A 7/2000 Frederick, Jr. et al.
6,110,020 A 8/2000 Rolfi
6,121,556 A 9/2000 Cole
6,237,462 B1 5/2001 Hawkes et al.
6,254,100 B1 7/2001 Rinehart
6,260,463 B1 7/2001 Brand et al.
6,269,578 B1 8/2001 Callegari
6,283,428 B1 9/2001 Maples et al.
6,289,622 B1 9/2001 Desch, Jr. et al.
6,293,041 B2 9/2001 Weaver

(56) References Cited

U.S. PATENT DOCUMENTS

| | | | |
|---|---|---|---|
| 6,294,759 | B1 | 9/2001 | Dunn, Jr. |
| 6,305,117 | B1 | 10/2001 | Hales, Sr. |
| 6,309,476 | B1 | 10/2001 | Ravenscroft et al. |
| 6,338,218 | B1 | 1/2002 | Hegler |
| 6,390,294 | B1 | 5/2002 | Fiore et al. |
| 6,397,720 | B1 | 6/2002 | Fox et al. |
| 6,439,515 | B1 | 8/2002 | Powers |
| 6,439,530 | B1 | 8/2002 | Shoenfish et al. |
| 6,517,133 | B2 | 2/2003 | Seegmiller et al. |
| D471,248 | S | 3/2003 | Jacobs |
| 6,526,687 | B1 | 3/2003 | Looney |
| D473,376 | S | 4/2003 | Abate |
| 6,546,662 | B1 | 4/2003 | Chong |
| 6,557,855 | B2 | 5/2003 | Wu |
| 6,574,899 | B1 | 6/2003 | Mostello |
| 6,575,469 | B2 | 6/2003 | Lowe |
| 6,643,973 | B1 | 11/2003 | Smith |
| 6,663,298 | B2 | 12/2003 | Haney |
| 6,688,031 | B2 | 2/2004 | Steele |
| 6,733,375 | B2 | 5/2004 | Hoffman |
| 6,736,400 | B1 | 5/2004 | Cesternino |
| 6,813,855 | B2 | 11/2004 | Pinkley |
| 6,814,654 | B2 | 11/2004 | Rolfi |
| 6,854,975 | B2 | 2/2005 | Ranzinger |
| 6,860,054 | B1 | 3/2005 | Mosher |
| 6,860,055 | B1 | 3/2005 | Walrath |
| 6,862,833 | B1 | 3/2005 | Gutner |
| 6,871,440 | B2 | 3/2005 | Highfill et al. |
| 6,877,266 | B1 | 4/2005 | Brownlee |
| 6,883,263 | B1 | 4/2005 | Carrow |
| 6,931,777 | B1 | 8/2005 | Krien |
| 6,953,114 | B2 | 10/2005 | Wang |
| D513,055 | S | 12/2005 | Lahti |
| 6,978,569 | B2 | 12/2005 | Williamson, IV et al. |
| D519,183 | S | 4/2006 | Minneman |
| 7,032,494 | B2 | 4/2006 | Wygant |
| D521,100 | S | 5/2006 | Morrow |
| 7,043,862 | B2 | 5/2006 | Franks |
| 7,055,279 | B2 | 6/2006 | Flores |
| 7,062,979 | B2 | 6/2006 | Day et al. |
| D524,541 | S | 7/2006 | Cauley |
| 7,086,192 | B2 | 8/2006 | Deros |
| 7,104,398 | B1 | 9/2006 | Wisecarver |
| 7,134,663 | B1 | 11/2006 | Lowe et al. |
| 7,143,986 | B1 | 12/2006 | Austin et al. |
| 7,152,355 | B2 | 12/2006 | Fitzpatrick et al. |
| 7,152,358 | B1 | 12/2006 | LeAnna et al. |
| 7,159,711 | B1 | 1/2007 | Gardner |
| 7,165,750 | B2 | 1/2007 | McCuskey et al. |
| 7,188,445 | B2 | 3/2007 | Lehman |
| D540,904 | S | 4/2007 | Werner |
| 7,200,966 | B2 | 4/2007 | Gooder |
| 7,201,376 | B2 | 4/2007 | Kuosa |
| 7,207,567 | B1 | 4/2007 | Brown |
| D543,604 | S | 5/2007 | Minneman |
| 7,213,494 | B2 | 5/2007 | James |
| 7,216,404 | B1 | 5/2007 | Doyle |
| 7,222,451 | B2 | 5/2007 | Keng et al. |
| 7,225,050 | B2 | 5/2007 | Sutula, Jr. |
| 7,246,704 | B2 | 7/2007 | Brunson et al. |
| 7,258,345 | B2 | 8/2007 | Anderson, Jr. |
| D553,219 | S | 10/2007 | Potterfield |
| 7,281,346 | B1 | 10/2007 | Cook et al. |
| D567,895 | S | 4/2008 | Cauley |
| 7,356,960 | B1 | 4/2008 | Knitt |
| 7,356,961 | B2 | 4/2008 | Williams |
| 7,357,250 | B2 | 4/2008 | Hagemann |
| 7,363,740 | B2 | 4/2008 | Kincel |
| 7,367,451 | B2 | 5/2008 | Pendergraph et al. |
| 7,401,431 | B2 | 7/2008 | Pierce et al. |
| 7,410,053 | B2 | 8/2008 | Bowen et al. |
| D576,245 | S | 9/2008 | Potterfield et al. |
| 7,421,815 | B1 | 9/2008 | Moody et al. |
| 7,426,800 | B2 | 9/2008 | Pierce et al. |
| 7,431,247 | B2 | 10/2008 | Bobro |
| 7,481,015 | B2 | 1/2009 | Mays |
| 7,536,819 | B2 | 5/2009 | Popikow |
| 7,536,820 | B2 | 5/2009 | Wade et al. |
| 7,549,247 | B1 | 6/2009 | Reese |
| 7,584,690 | B2 | 9/2009 | Cauley |
| D605,246 | S | 12/2009 | Hobbs |
| 7,631,455 | B2 | 12/2009 | Keng et al. |
| 7,631,877 | B2 | 12/2009 | Zara |
| 7,654,498 | B1 | 2/2010 | Beltz |
| 7,658,140 | B2 | 2/2010 | Lombardi |
| 7,665,241 | B2 | 2/2010 | Oz |
| 7,676,977 | B1 | 3/2010 | Cahill et al. |
| 7,681,886 | B2 | 3/2010 | Morrow et al. |
| 7,694,973 | B1 | 4/2010 | Hofmeister |
| 7,713,180 | B2 | 5/2010 | Wickens et al. |
| 7,726,478 | B2 | 6/2010 | Potterfield et al. |
| 7,730,824 | B1 | 6/2010 | Black |
| 7,743,544 | B2 | 6/2010 | Laney et al. |
| 7,774,972 | B2 | 8/2010 | Potterfield et al. |
| 7,779,572 | B2 | 8/2010 | Potterfield et al. |
| 7,823,317 | B2 | 11/2010 | Potterfield et al. |
| 7,845,267 | B2 | 12/2010 | Potterfield et al. |
| 7,866,081 | B2 | 1/2011 | Seuk |
| 7,883,396 | B2 | 2/2011 | Potterfield et al. |
| 7,954,272 | B2 | 6/2011 | Potterfield et al. |
| 7,997,021 | B2 | 8/2011 | Cauley |
| 8,011,129 | B2 | 9/2011 | Cauley et al. |
| 8,104,212 | B2 | 1/2012 | Potterfield et al. |
| 8,296,988 | B2 | 10/2012 | Yale et al. |
| 8,336,708 | B2 | 12/2012 | Potterfield et al. |
| 8,371,057 | B2 | 2/2013 | Coffield et al. |
| 8,444,056 | B2 | 5/2013 | Gamez et al. |
| 8,496,212 | B2 | 7/2013 | Keng et al. |
| 2002/0195752 | A1 | 12/2002 | Yang |
| 2003/0234205 | A1 | 12/2003 | McGuyer et al. |
| 2004/0112777 | A1 | 6/2004 | Huang |
| 2004/0134113 | A1 | 7/2004 | Deros et al. |
| 2005/0115137 | A1 | 6/2005 | Minneman |
| 2006/0065560 | A1 | 3/2006 | Dickenson et al. |
| 2006/0175213 | A1 | 8/2006 | Hurt et al. |
| 2006/0230664 | A1* | 10/2006 | Eddins ..... 42/94 |
| 2006/0254111 | A1 | 11/2006 | Giauque et al. |
| 2006/0277811 | A1 | 12/2006 | Peterson |
| 2007/0051028 | A1 | 3/2007 | Stordal |
| 2007/0068379 | A1 | 3/2007 | Sween et al. |
| 2007/0068835 | A1 | 3/2007 | Buie, III |
| 2007/0094911 | A1 | 5/2007 | Rush et al. |
| 2007/0113460 | A1 | 5/2007 | Potterfield et al. |
| 2007/0256346 | A1 | 11/2007 | Potterfield et al. |
| 2007/0295197 | A1 | 12/2007 | Potterfield |
| 2008/0023379 | A1 | 1/2008 | Potterfield et al. |
| 2008/0054570 | A1 | 3/2008 | Potterfield et al. |
| 2008/0061509 | A1 | 3/2008 | Potterfield |
| 2008/0128002 | A1 | 6/2008 | Jeffs |
| 2008/0156671 | A1 | 7/2008 | Jansson |
| 2008/0174071 | A1 | 7/2008 | Potterfield et al. |
| 2008/0263928 | A1 | 10/2008 | Potterfield |
| 2009/0126250 | A1 | 5/2009 | Keng |
| 2009/0188146 | A1 | 7/2009 | Werner |
| 2010/0102178 | A1 | 4/2010 | Smith et al. |
| 2010/0126055 | A1 | 5/2010 | Potterfield |
| 2010/0138032 | A1 | 6/2010 | Potterfield |
| 2010/0236125 | A1 | 9/2010 | Morrow et al. |
| 2010/0270201 | A1 | 10/2010 | Cauley et al. |
| 2011/0024985 | A1 | 2/2011 | Potterfield et al. |
| 2011/0036214 | A1 | 2/2011 | Potterfield |
| 2011/0094140 | A1 | 4/2011 | Letson |
| 2012/0175844 | A1 | 7/2012 | Potterfield |

OTHER PUBLICATIONS

"Cleaning Cradles: Sinclaire Cleaning Cradles" p. 21. 1 pg. The date on which the Sinclair Folding Cleaning Cradle was first on sale is not known, but is believed to be circa 2004.

"Decker Rifle Vise", 1 pg. The date on which the Decker Rifle Vise was first on sale is not known, but is believed to be circa 2004.

"The Grabber and Hustler '76," MEC—Mayville Engineering Company, Inc., 2 pgs., undated.

(56) References Cited

OTHER PUBLICATIONS

"Uncle Bud's Bull Bags," http:www.unclebudscss.com/pages/Bulls%20bags.html, 2 pgs. [Internet accessed on Feb. 14, 2006].
"Uncle Bud's Udder Bag," http:www.unclebudscss.com/pages/Udder%20Bags.html, 2 pgs. [Internet accessed on Feb. 14, 2006].
1Shop2.com. "Hoppe's Gunsmith's Fully Adjustable Bench Vise", 3 pgs. The date on which The Hoppe's Gunsmith's Fully Adjustable Bench Vise was first on sale is not known, but is believed to be circa 2004.
AcuSport Outdoor Sporting Products, 3 pgs.
Amazon.com, "CTK® P3 Ultimate Shooting Rest," Sports & Outdoors, http://www.amazon.com/CTK%C2%AE-P3-Uitimate-Shooting-Rest/dp/ . . . , 1 pg. [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin . . . , 1 pg. [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/BO . . . , 1 pg. [Internet accessed on Jul. 22, 2008].
Basspro.com, "Bass Pro Shops Outdoors Online: Offering the best in Fishing, Hunting and Outdoor Products," http://www.basspro.com/webapp/wcs/stores/servlet/Product 10151 -1 10001 95064 SearchResults, 2 pgs. [Internet accessed on Aug. 6, 2008].
Battenfeld Technologies, Inc., "Gun Vise," Tipton Gun Cleaning Supplies, Battenfeld Technologies, Inc. 2004 Catalog, p. 32, Product No. 782-731, 2 pgs.
Battenfeld Technologies, Inc., "Steady Rest Portable Shooting Rest," file://C:\DOCUME-1\DUTCD\LOCALS-1\Temp\PQ28V28J.htm, 1 pg., accessed Jan. 25, 2006.
Big Boy Gun Toys, "Shooting Rest," http://www.bigboyguntoys.com/shootingrest.htm, 1 pg. [Internet accessed on Jul. 18, 2008].
Boyt Harness Company, Product Catalog, http://www.boytharness.com/catalog/index.php?cPath=22, 2 pgs. [Internet accessed on Jul. 21, 2008].
Brownells, Inc., Catalog No. 41, 1988-1989, 3 pgs.
Brownells, Inc., Catalog No. 57, 2004-2005, 2 pgs.
Brownells, Inc., Catalog No. 47, 1994-1995, 2 pgs.
Brownells, Inc., Sight Base Cutters, Faxed Dec. 17, 2003, 1 pg.
Cabela's Hunting Fishing and Outdoor Gear Master Catalog, Fall2002, Edition II, Minimizer Rifle Rest, Item No. SC-22-4332 and SC-22-4333, p. 492.
Cabela's: World's Foremost Outfitter. "HySkore Sighting System and Cleaning Vise". 1 pg. The date on which the HySkore Sighting System and Cleaning Vise was first on sale is not known, but is believed to be circa Jan. 2005. However, a prototype of this product may have been shown to buyers at Cabela's circa Aug. 2004.
Cabela's. "Master Catalog Fall 2003: Late-Season Edition". Cover page and p. 416. 2 pgs.
Cabela's, "BenchBuddy® Gun Rest," http://www.cabelas.com/cabelas/en/templates/links/link.jsp?id=0005819221954a &type=product&cmCat=, © 1996-2008, 2 pgs. [Internet accessed on Aug. 6, 2008].
Cabela's, "Elite Rifle Rest," http://www.cabelas.com/cabelas/en/templates/links/link.jsp?id=0005817227855a&type=product &cmCat=, © 1996-2008, 2 pgs. [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pgs. [Internet accessed on Aug. 6, 2008].
Cabela's, "Hyskore® Ultimate Sighting Rest," http://www.cabelas.com/cabelas/en/templates/links/link.jsp?id=0024152226083a &type=product&cmCat=, © 1996-2008, 2 pgs. [Internet accessed on Aug. 6, 2008].
Cabela's, "Nitro Shoulder Shield Rest," http://www.cabelas.com/cabelas/en/templates/links/link.jsp?id=0040862228231a &type=product&cmCat=, © 1996-2008, 2 pgs. [Internet accessed on Aug. 6, 2008].
Cabela's, "Premier Rifle Rest," http://www.cabelas.com/cabelas/en/templates/links/link.jsp?id=0020904227856a&type=product &cmCat= . . . , © 1996-2008, 2 pgs. [Internet accessed on Aug. 6, 2008].
Cabela's, "Secure Bench Rest," http://www.cabelas.com/cabelas/en/templates/links/link.jsp;jsessionid=4F0LP0OW2HMRLLAOBBISCOF . . . , © 1996-2008, 2 pgs. [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pgs. [Internet accessed on Aug. 6, 2008].
Cabela's, "Shooting Benches & Portable Rifle Shooting Bench Rest," http://www.cabelas.com/ssubcat-1/cat20793.shtml, 3 pgs. [Internet accessed Jul. 18, 2008].
Cabela's, "Sure Shot Shooting Vise/Rest," http://www.cabelas.com/cabelas/en/templates/product/standard-item.jsp?id=00348272277 . . . , © 1996-2008, 2 pgs. [Internet accessed on Jul. 15, 2008].
Caldwell Shooting Supplies, 2006 Catalog, pp. 18, 5, 12, 14 and 15. 5 pgs.
Californiavarmintcallers.com—Forum, http://californiavarmintcallers.com/community/modules/newbb/viewtopic.php?topic_id=10 &forum=9&PHPSESSID=074ed8c7 . . . pp. 1-4 accessed Jan. 16, 2006.
Canadian Camo, "Gun Rest," https://media5.magma.ca/www.canadiancamo.com/catalog/product_info.php?products_id= . . . , 2 pgs. [Internet accessed on Feb. 13, 2006].
Champion Traps & Target, 2005 Product Catalog, 12 pgs.
CTK Precision, "P3 Ultimate Shooting Rest," http://www.ctkprecision.com/index.asp?PageAction=VIEWPROD&ProdOID=2, 3 pgs. [Internet accessed on Jul. 18, 2008].
CTK Precision, All Products, http://www.ctkprecision.com/index.asp?PageAction=VI EWCATS&Cate . . . , 3 pgs. [Internet accessed on Jul. 22, 2008].
CV-500, 3 pgs. [product photos].
E. Arthur Brown Company, "A Shooting Rest that Really Works . . . ," http://www.eabco.comfTargetShooting01.html, © 2007-2008, 1 pg. [Internet accessed Jul. 18, 2008].
Edgewood Shooting Bags Catalog, http://www.edgebag.com/catalog.php, 7 pgs. [Internet accessed on Feb. 14, 2006].
Ellett Brothers, Rests & Gun Vises, 3 pgs.
Four photos of the Lohman Sight Vise. 4 pgs. The date on which the Lohman Sight Vise was first on sale is not known, but is believed to be circa 2004.
Grafix® Plastics, http://www.grafixplastics.com/plastic_film_g.asp?gclid=CK-5-7gnY4CFRVNhQodjFhfSQ, 29 pgs. [Internet accessed on Aug. 30, 2007].
"Gun Rest—Shooting Rest—Rifle Rests," http://www.exploreproducts.com/gunrests-shootingrests.htm, 6 pgs. [Internet accessed Jul. 18, 2008].
Hyskore, "Rest—Dangerous Game Machine Rest," Hyskore Rest, Professional firearm rests, http://www.hyskore.com/rests.htm, 2 pgs. [Internet accessed Jul. 21, 2008].
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Joe's, "Shooter's Ridge Steady Point Shooting Rest," http://www.joessports.com/product/index.jsp?productId=3155005&cp=726872 &parentPag . . . , Item No. 3155005, 1 pg. [Internet accessed Jul. 17, 2008].
Lahti Company Brochure, "Rifle Evaluator: No Pain, No Fear, No Flinching, No Body Movement," www.lahticompany.com, 2 pgs., Undated.
Lahti Company, Evaluator Brochure, http://www.lathicompany.com/Forms/EvaluatorBrochure2.jpg., accessed Jan. 16, 2006.
MacksPW.com, "Desert Mountain Bench Master Rifle Rest," http://www.macksqw.com/Item-i-DESBM1, © 2004-2008, 1 pg. [Internet accessed Jul. 22, 2008].

(56) References Cited

OTHER PUBLICATIONS

Midway USA, "Shooters Ridge Steady Point Rifle Shooting Rest," http://www.midwayusa.com/eproductpage.exe/showproduct?saleitemid=826745&t=11082005, 2005, 5 pgs. [Internet accessed on Aug. 6, 2008].
Midway USA. "Tipton Range Box with Ultimate Rifle, Handgun Cleaning Kit (No Solvents)" <URL: http://www.midwayusa.com/rewriteaproducU135086>. 2 pgs. The date on which the Tipton Range Box was first on sale is not known, but is believed to be circa 2004.
MidwayUSA, "ADG Rifle Shooting Rest," http://www.midwayusa.com/eproductpage.exe/showproduct?saleitemid=992071 &t=11082005, 2005, 3 pgs. [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pgs. [Internet accessed on Aug. 6, 2008].
MidwayUSA, "Caldwell Lead Sled DFT Rifle Shooting Rest," http://www. midwayusa.com/eproductpage.exe/showproduct?saleitemid=149023&t=11082005, 2005, 6 pgs. [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pgs. [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pgs. [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pgs. [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pgs. [Internet accessed on Aug. 6, 20081.
MidwayUSA, "Hyskore® dangerous Game Rifle Shooting Rest," http://www.midwayusa.com/eproductpage.exe/showproduct?saleitemid=729197&t=11082005, 2005, 3 pgs. [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 3 pgs. [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005,2005, 3 pgs. [Internet accessed on Aug. 6, 2008].
MidwayUSA, "Shooters Ridge Steady Point Rifle Shooting Rest with Vise," http://www.midwayusa.com/eproductpage.exe/showproduct?saleitemid=341095&t=11082005, D 2005, 4 pgs. [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin . . . , 15 pgs. [Internet accessed on Jul. 21, 2008].
MidwayUSA, "Stoney Point Bench Anchor Rifle Shooting Rest," http://www.midwayusa.com/eproductpage.exe/showproduct?saleitemid=347174&t=11082005, 2005, 2 pgs. [Internet accessed on Aug. 6, 2008].
Milek, B., "Handloading for Hunting" New Products from RCBS, Lee, Accurate Arms, Peterson's Hunting, Mar. 1985, p. 21. 1 pg.
Millett, "BenchMaster Shooting Rests," 1 pg. Undated.
MTM Case-Gard. "Gun Maintenance Centers." 2 pgs. The date on which the MTM Gun Maintenance Center was first on sale is not known, but is believed to be circa 2004.
MTM Case-Gard. "Rifle rest and pistol shooting rest". <URL: http://www.mtmcasegard.corn/products/shooting/shoo.html>. 3 pgs. The date on which the MTM Site-In-Clean was first on sale is not known, but is believed to be circa 2004.
MTM Shoulder-Gard Rifle Rest, MTM Case-Gard, p. 2 "Rests", 1 pg.
Precision Shooting, Inc., Bald Eagle Front Rest, The Accurate Rifle, vol. 6, Issue No. 4, May 2003, p. 47. 1 pg.
Protektor Model, "The Original Leather Rifle and Pistol Rest," http://www.protektormodel.com/, 12 pgs. [Internet accessed on Feb. 14, 2006].
Shooters Ridge, "Deluxe Rifle Rest," http://www.shootersridge.com, 1 pg. [Internet accessed Jul. 21, 2008].
Shooters Ridge, "Shooting Rest with Gun Vise," http://www.shootersridge.com, 1 pg. [Internet accessed Jul. 17, 2008].
Sinclair International, Sinclair Shooting Rests, Products for the Precision Shooter, 2002, Issue No. 2002-B, pp. 76-78.
Sweeney, P "Gunsmithing: Measure Headspace," Peterson's Rifleshooter, http://www.rifleshootermag.com/gunsmithing/headspace_0612/, 4 pgs. [Internet Accessed Dec. 11, 2004].
Tenex Precision Co. "Recoil A-Rest-R" Product Pictures, 4 sheets, Riverside CA.
The Sportsman's Guide. "Plano Shooters Case!" <URL: http://www.sportsmansguide.com/cb/cb.asp?a=148225>. 3 pgs. The date on which the Plano Shooters Case was first on sale is not known, but is believed to be circa 2004.
Cabela's, "Sharp Shooter Rifle Rest," http://www.cabelas.com/cabelas/en/templates/links/link.jsp?id=0005816222738a &type=product&cmCat=, © 1996-2008, 2 pgs. [Internet accessed on Aug. 6, 2008].
Office Action issued Jun. 7, 2006, U.S. Appl. No. 10/865,595, 6 pgs.
Final Office Action issued Apr. 3, 2007, U.S. Appl. No. 10/865,595, 8 pgs.
BPAI Decision issued Feb. 2, 2011, U.S. Appl. No. 10/865,595, 8 pgs.
Office Action issued Mar. 2, 2009, U.S. Appl. No. 11/431,956, 16 pgs.
Final Office Action issued Nov. 27, 2009, U.S. Appl. No. 11/431,956, 13 pgs.
Restriction Requirement issued Jul. 26, 2010, U.S. Appl. No. 11/431,956, 6 pgs.
Office Action issued Feb. 9, 2011, U.S. Appl. No. 11/431,956, 7 pgs.
Final Office Action issued Oct. 6, 2011, U.S. Appl. No. 11/431,956, 8 pgs.
Office Action issued May 7, 2012, U.S. Appl. No. 11/431,956, 10 pgs.
Final Office Action issued Nov. 23, 2012, U.S. Appl. No. 11/431,956, 10 pgs.
Restriction Requirement issued May 7, 2013, U.S. Appl. No. 11/431,956, 6 pgs.
Office Action issued Feb. 1, 2012, U.S. Appl. No. 13/009,389, 13 pgs.
Final Office Action issued Aug. 16, 2012, U.S. Appl. No. 13/009,389, 11 pgs.
Restriction Requirement issued Feb. 28, 2013, U.S. Appl. No. 13/009,389, 5 pgs.
Office Action issued Apr. 12, 2013, U.S. Appl. No. 13/009,389, 10 pgs.

* cited by examiner

SHOOTING RESTS FOR SUPPORTING FIREARMS

CROSS-REFERENCE TO RELATED APPLICATIONS

This application is a divisional of U.S. patent application Ser. No. 11/431,956, filed on May. 10, 2006, now U.S. Pat. No. 8,621,773, which is a continuation-in-part U.S. patent application Ser. No. 10/865,595, filed on Jun. 10,2004, now U.S. Pat. No. 8,011,129, which claims priority to U.S. Provisional Patent Application No. 60/478,557, filed Jun. 13, 2003, each of which is hereby incorporated by reference in its entirety.

TECHNICAL FIELD

The present invention is directed to shooting rests for supporting firearms.

BACKGROUND

Firearm shooting sports are often associated with the sometimes painful recoil that may result from shooting firearms. Recoil from large caliber firearms can cause a shooter to flinch or jerk the firearm trigger in anticipation of the shock to the shooter's upper body. Flinching or jerking the trigger in anticipation of recoil is a common negative factor in a shooter's accuracy. Recoil can be described as the equal and opposite reaction to the momentum of an ammunition cartridge's projectile (e.g., bullet) and gunpowder charge upon firing of the cartridge. This momentum is imparted to the firearm, causing it to travel in the opposite direction of the fired bullet. The resulting recoil energy of the firearm can be calculated using the following equation derived from the Law of Conservation of Momentum:

$$\text{Recoil Energy (ft-lbs)} = \frac{(\text{Bullet Weight} \times \text{Bullet Velocity} + 4700 \times \text{Gunpowder Weight})\text{^}2}{64.348 \times \text{Firearm Weight}}$$

Where 4700 is the velocity of the gases generated by the burning gunpowder and 64.348 is a correction factor for the acceleration of gravity.

As can be seen by the above equation, increasing the Firearm Weight will result in a decreased Recoil Energy. As is common to the art of firearm manufacture, large caliber, heavy recoiling firearms are designed to be heavier in weight than small caliber, low recoiling firearms for precisely this reason. The additional weight has a dampening effect on the recoil felt by the shooter.

To test the accuracy of a firearm, a shooter will commonly shoot with the firearm placed atop a shooting rest, which in turn is placed on a bench. The shooter then fires the firearm from a sitting position behind the bench. This type of arrangement minimizes the shooting errors caused by the inability of the human body to hold a firearm perfectly steady and provides a steady, accurate method of supporting a firearm while shooting. Shooting from a bench has the drawback of subjecting the shooter to a higher degree of "effective recoil." Actual recoil energy of the firearm does not increase by shooting from a bench, but more of the recoil energy is transferred to the shooter in a sitting position than in a standing position. The standing position allows the entirety of the shooter's body to flex and partially absorb the recoil energy. In the sitting position, however, only the torso (i.e., shoulder to waist) of the shooter is available to flex and absorb the recoil. Because of the higher "effective recoil" when firing from a sitting position, shooting a large caliber, heavy recoiling firearm from a bench can create an unpleasant experience when firing more than a few rounds. It is common for a shooter to fire upwards of twenty rounds when zeroing, or sighting-in, especially in the case of rifles and shotguns using telescopic sights.

DETAILED DESCRIPTION

A. Overview

Figure 1:
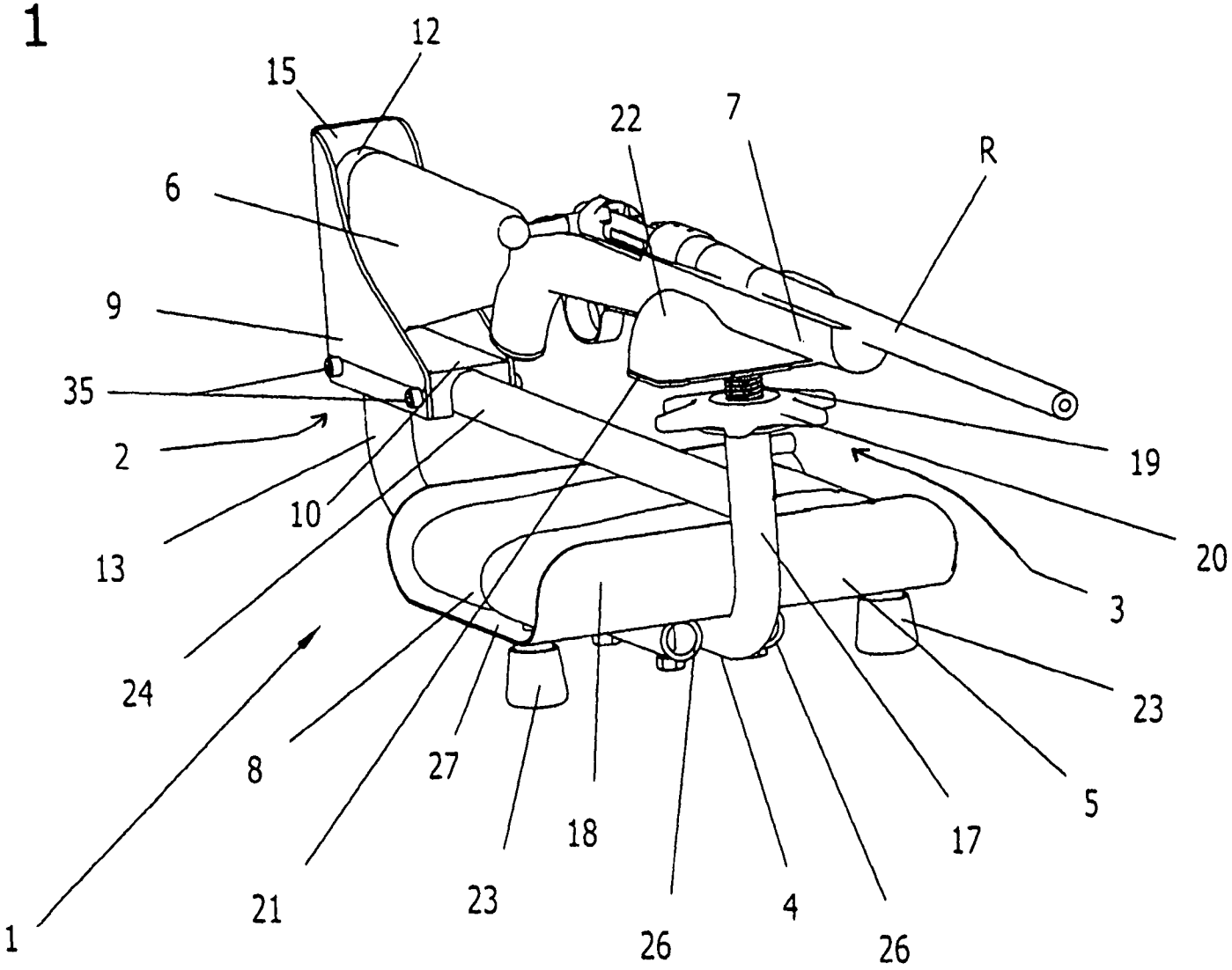
FIG. 1 is a perspective view of one embodiment of a recoil-reducing shooting rest with a rifle mounted in a firing position.

The following disclosure describes several embodiments of shooting rests for supporting firearms. One feature of several embodiments of the invention is that the shooting rests are expected to reduce the recoil energy experienced by a shooter without modifying the firearm. For example, the shooting rests in these embodiments include a support member for carrying one or more weights, which reduce the recoil. Specifically, when the firearm is fired, the firearm and shooting rest can be considered as a single unit subjected to the firearm's recoil energy. Mathematically, the weight of the shooting rest can be added to the weight of the firearm to yield a total Firearm Weight as used in the above-noted Recoil Energy equation. Because the total Firearm Weight is inversely proportional to recoil energy, adding more weight to the shooting rest results in a corresponding reduction in recoil energy.

One aspect of the invention is directed to shooting rests for supporting a firearm having a first portion and a second portion rearward of the first portion. In one embodiment, a shooting rest includes a frame, a front support for supporting the first portion of the firearm, a support member for carrying one or more weights, and a stop for inhibiting rearward movement of the firearm relative to the shooting rest. The front support is coupled to the frame, and the support member is positioned at least proximate to the frame. The stop includes a flexible portion and is also coupled to the frame.

In another embodiment, a shooting rest includes a frame, a rear support coupled to the frame and positioned to carry the rear portion of the firearm, a front support movably coupled to the frame and positioned to carry the first portion of the firearm, a support member proximate to the frame, and an inhibiting member coupled to the frame and configured to inhibit rearward movement of the firearm relative to the rear support. The front support is selectively movable in a direction generally parallel to an axis defined by the firearm. The support surface includes a surface for carrying a removable weight.

In another embodiment, a shooting rest includes a front support for supporting the first portion of the firearm, a rear support for supporting the second portion of the firearm, a support member for carrying a supplemental weight, and a stop for inhibiting rearward movement of the firearm relative to the shooting rest. The rear support is disconnected from the front support. The support member and the stop are coupled to the rear support.

Specific details of several embodiments of the invention are described below with reference to shooting rests for supporting firearms. Although several of the figures illustrate particular embodiments of shooting rests supporting rifles, those shooting rests can also be configured to support other types of firearms (e.g., shotguns). Several details describing well-known structures or processes often associated with shooting rests and firearms are not set forth in the following description for purposes of brevity and clarity. Also, several other embodiments of the invention can have different configurations, components, or procedures than those described in this section. A person of ordinary skill in the art, therefore, will accordingly understand that the invention may have other embodiments with additional elements, or the invention may have other embodiments without several of the elements shown and described below with reference to FIGS. 1-11. Where the context permits, singular or plural terms may also include the plural or singular term, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or other types of features and components are not precluded.

B. Embodiments of Shooting Rests

Figure 2:
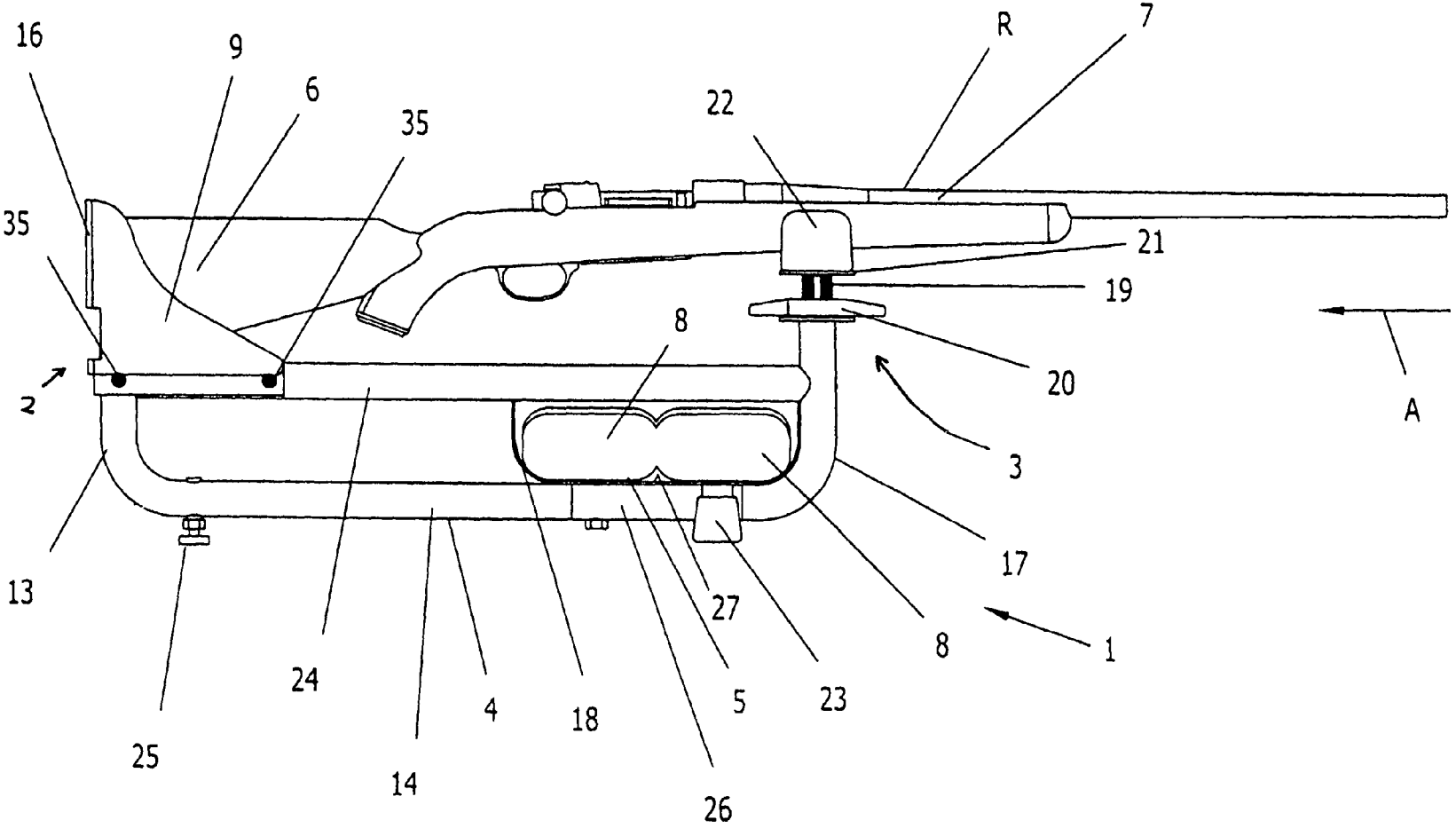
FIG. 2 is a side view of the shooting rest of FIG. 1.
Figure 3:
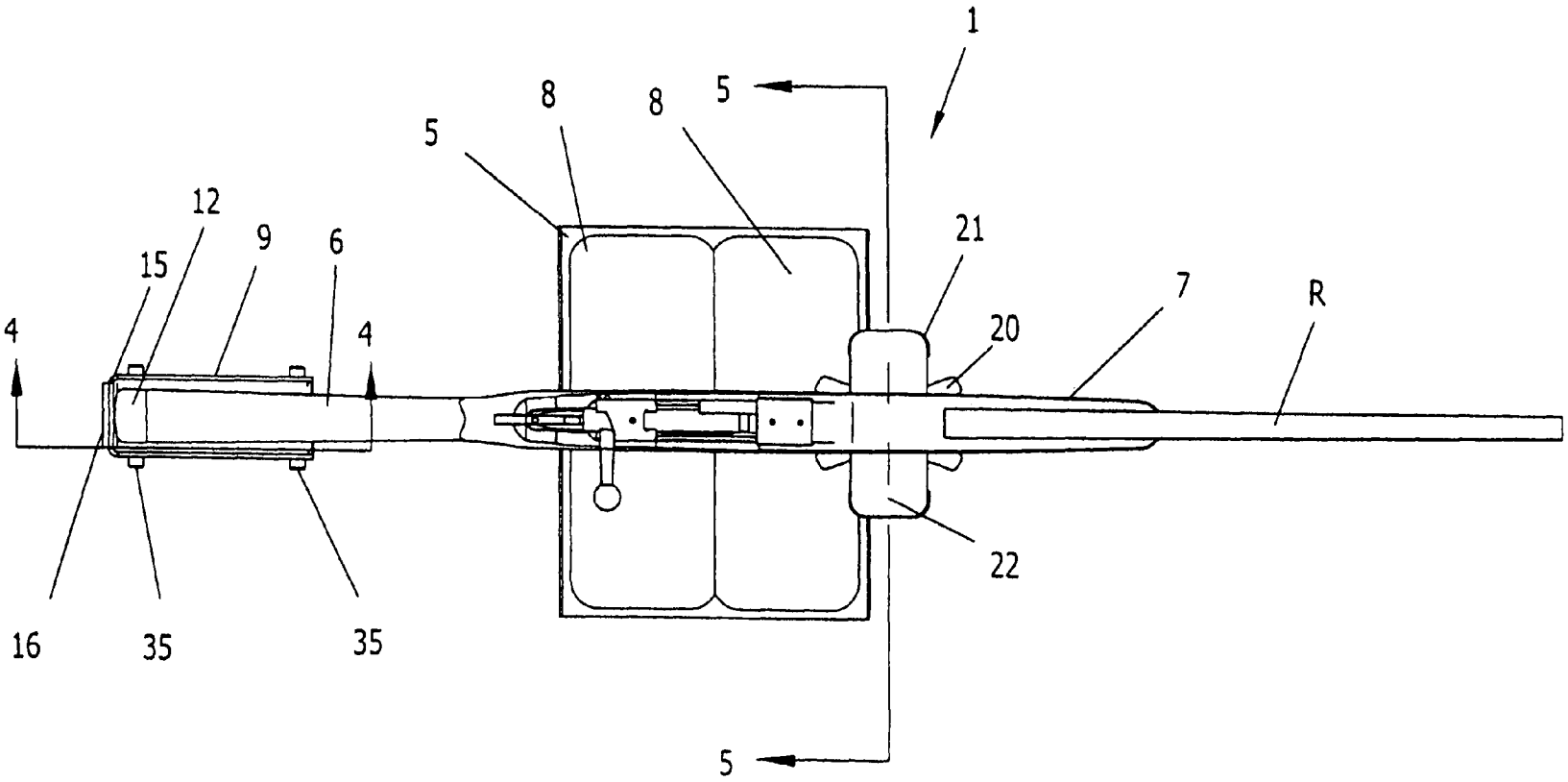
FIG. 3 is a top view of the shooting rest of FIG. 1.

FIGS. 1-3 illustrate one embodiment of a shooting rest 1 from varying angles with a firearm R (e.g., a rifle) placed atop the unit in the shooting position. The illustrated shooting rest 1 includes four main subsystems, namely, a rear support 2, a front support 3, a frame 4, and a support member or holder 5. The rear support 2 supports a buttstock 6 of the firearm R and the front support 3 supports the forend 7 of the firearm R. The frame 4 connects the rear support 2, front support 3, and holder 5 so that the shooting rest 1 is a single, rigid unit.

In one embodiment, the frame 4 is constructed of steel tubing and comprises a rear vertical section 13, a horizontal base section 14, a front vertical section 17, and a horizontal support member 24. The frame 4 provides a rigid infrastructure to the shooting rest 1 by joining all the subsystems in a single unit. The illustrated shooting rest 1 has three points of contact with a bench or other flat surface but in other embodiments the shooting rest may have more or less than three points of contact with the bench. In the illustrated embodiment, a rear foot 25 is located on the horizontal base section 14 of the frame 4, generally near the rear of the shooting rest 1 and two front feet 23 are located toward the outside edges of the holder 5. A three-point contact, or tripod arrangement, provides a stable and self-leveling configuration of the shooting rest 1. The front feet 23 and the rear foot 25 provide a non-marring surface for contact of the shooting rest 1 with the bench and may also provide a large coefficient of friction between the shooting rest and the bench to minimize movement of the shooting rest during firearm discharge. The rear foot 25 can be threadably engaged to the horizontal base section 14. The threaded engagement allows for elevation adjustment for the rear portion of the shooting rest 1. The front feet 23 can be attached to the holder 5 by conventional fasteners (e.g. sheet metal screws not shown). In other embodiments, the frame 4 may have a different configuration.

Figure 4:
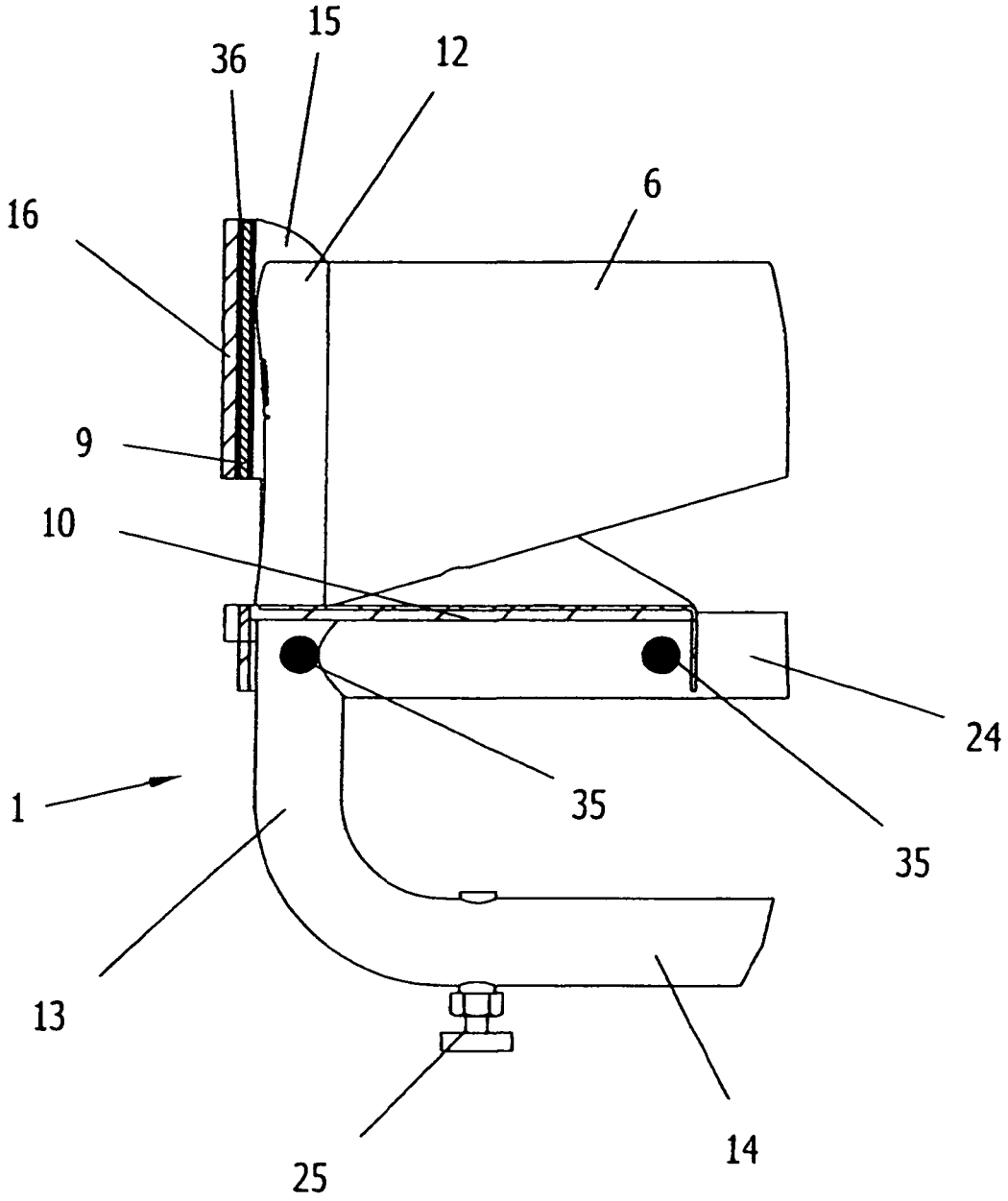
FIG. 4 is a detailed section view of a portion of the shooting rest taken along the plane including line 4-4 of FIG. 3.

The rear support 2 carries the buttstock 6 and provides the main transfer point of the recoil energy from the firearm R to the frame 4 of the shooting rest 1. In the illustrated embodiment, the rear support 2 includes of a buttstop 9, toe plate 10, and a recoil shoulder pad 16. As seen in FIG. 4, the rifle buttstock 6 rests atop the toe plate 10 with the rear surface of the buttstock, called a buttplate 12, contacting the inside surface 15 of the buttstop 9. In one embodiment, the buttstop 9 is formed from sheet metal and has two side panels and a rear panel that contacts the rear surface of the rifle buttstock 6. The buttstop 9 is rigidly connected to the toe plate 10, the rear vertical section 13 of the frame 4, and the horizontal support member 24 of the frame 4. In one embodiment, the buttstop 9 and toe plate 10 are fixed to the rear vertical section 13 and horizontal support member 24 of the frame 4 by threaded fasteners (e.g., bolts 35 in FIG. 4). Firing the firearm R will urge the firearm R to translate in a rearward direction, as indicated by arrow A in FIG. 2. With the buttplate 12 in contact with the inside surface 15 of the buttstop 9, the recoil energy of the firearm R will be transferred to the buttstop 9, and therefore to the entire shooting rest 1. Moreover, the buttstop 9 inhibits rearward movement of the firearm R relative to the shooting rest 1. The recoil pad 16 can comprise a resilient foam pad attached (e.g., sewn) to a thin nylon sleeve 36 that fits over the buttstop 9 to provide a soft, comfortable surface for the shooter's shoulder (FIG. 4). The nylon sleeve 36 covers the inside surface 15 of the buttstop 9 to provide a non-marring surface for contact with the buttplate 12 of the firearm R. The rear support 2 can have a different configuration in other embodiments.

Figure 5:
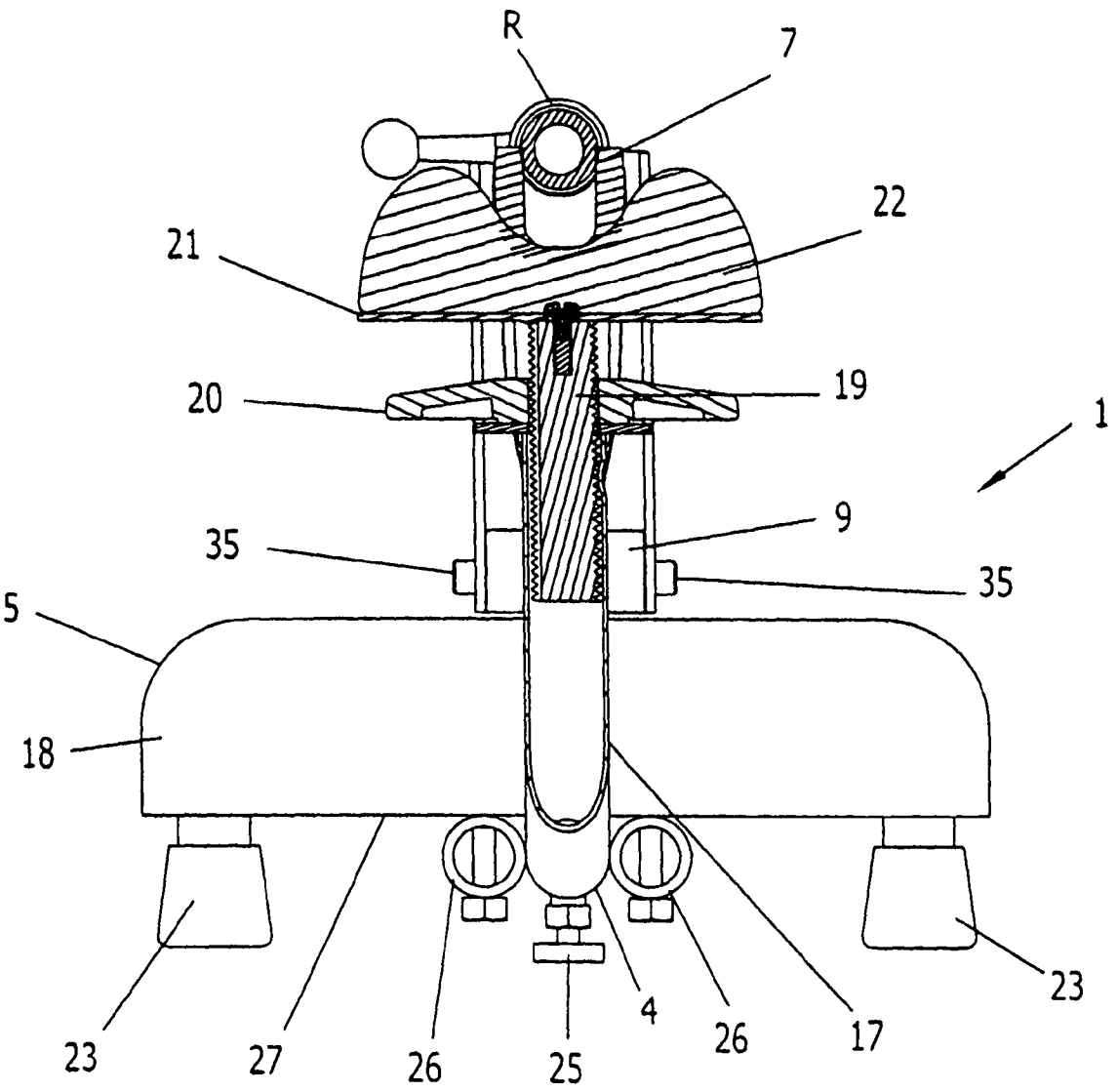
FIG. 5 is a section view taken along the plane including line 5-5 of FIG. 3.

Referring to FIGS. 1, 2, and 5, the illustrated front support 3 functions as a vertically adjustable (elevation adjustment) support for the firearm's forend 7. As shown in FIG. 5, a cylindrical, threaded ram 19 is removably inserted into an open end of the front vertical section 17 of the frame 4. A threaded adjustment wheel 20 rests atop the end of the front vertical section 17 of the frame 4 and is threadably engaged with the ram 19. Rotating the adjustment wheel 20 causes the ram 19 to translate vertically in relation, to the front vertical section 17 of the frame 4. A cradle 21 is rigidly joined to the top surface of the ram 19. In one embodiment, the cradle 21 is a stamped sheet metal platform that supports a bag 22 filled with sand, or other particulate media, that is shaped to fit the typical contour of the firearm's forend 7. When the adjustment wheel 20 is rotated, the ram 19 moves vertically causing corresponding movement of the cradle 21 to adjust the vertical position of the rifle forend 7 to a desired position.

In one embodiment, the support member or holder 5 is formed of sheet metal and is rigidly connected to the horizontal base section 14 of the frame 4. Two holder support tubes 26 can be attached to horizontal section 14 to add support and stability to the holder 5 by preventing it from rotating about the horizontal section 14. In the illustrated embodiment, the holder 5 has a generally U-shaped cross-section with front and back lips 18 that curve upward from a bottom surface 27 of the holder 5. The holder 5 provides a stable platform to receive weights 8 placed on the shooting rest 1 by the shooter and a structure for the attachment of the front feet 23 to the shooting rest 1. In other embodiments, the holder 5 may comprise other structures for supporting the weights 8 on the frame 4 or the weights may be attached directly to the frame 4. In the illustrated embodiment, the weights 8 are in the form of 25 lb. bags of lead shot due to their availability to a typical marksman and ease of portability. However, other forms of additional weight may be used. In the illustrated embodiment, the holder 5 is designed to hold up to four bags of lead shot 8, but only two bags are shown loaded on the holder. The lips 18 are sized to prevent the bags of lead shot 8 from shifting during discharge.

The subsystems of the shooting rest 1 may be joined via bolted or welded connections, for example, to form a rigidly constructed unit. In one embodiment, the shooting rest 1 can have a weight of approximately 15 lbs., an overall length of approximately 25 inches and a height of approximately 13 inches the shooting rest 1. Thus, the shooting rest 1 may be portable.

The recoil-reducing aspect of the shooting rest 1 is created by adding weight to the unit to increase resistance to the recoil of the firearm. Recoil energy is reduced when, according to the Law of Conservation of Momentum, the recoiling firearm encounters a greater opposing weight than merely the weight of the firearm alone. In the illustrated embodiment, the holder 5 supports this opposing weight (e.g., four 25 lb. bags of lead shot 8), so that the shooting rest 1 reduces recoil energy when the firearm R is discharged. According to the Law of Conservation of Momentum, written below in terms pertaining to the discussion, the Recoil Energy of the firearm can be calculated from the following equation:

$$\text{Recoil Energy (ft-lbs)} = \frac{(\text{Bullet Weight} \times \text{Bullet Velocity} + 4700 \times \text{Gunpowder Weight})\text{^}2}{64.348 \times \text{Firearm Weight}}$$

Where 4700 is the velocity of the gases generated by the burning gunpowder and 64.348 is a correction factor for the acceleration of gravity.

Increasing the Firearm Weight in the above-stated formula decreases the Recoil Energy. When the firearm is discharged, the firearm and the shooting rest 1 can be considered as a single unit subjected to the firearm's recoil. Mathematically, the weight of the shooting rest 1 can be added to the weight of the firearm R to yield a total Firearm Weight as used in the Recoil Energy equation. The more weight added to the rest 1, the higher the reduction in recoil. The illustrated holder 5 is designed to accept up to four 25 lb. bags of lead shot 8 but other types of weights could be used to increase the weight of the shooting rest 1. Twenty-five lb. bags of shot 8 are commonly available to the typical shooter and provide an easily portable system of weight addition for the shooting rest. In several applications, the recoil energy of a firearm can be reduced by up to 90% by adding weight to the shooting rest 1. The amount of weight needed to provide a certain percentage of recoil reduction is dependant on the caliber and size of the firearm used on the shooting rest 1.

In one embodiment of a method for operating the illustrated shooting rest 1, the shooter performs the following steps:

1) Place the shooting rest 1 on top of a relatively flat table or bench;
2) Place weights 8 on the holder 5 of the shooting rest 1;
3) Place the firearm R atop the shooting rest 1 in such a manner that the buttstock 6 of the firearm rests in the rear support 2 and the front support 3 cradles the forend 7 of the firearm;
4) Optionally adjust the vertical elevation of the front Support 3 and/or the rear foot 25 and/or make elevation sighting adjustments of the firearm R;
5) Sit behind the shooting rest 1 and firearm R with the rear support 2 of the shooting rest 1 close to the shooter. The shooting rest 1 may be oriented such that an imaginary line connecting the rear and front supports 2 and 3 is generally perpendicular to an imaginary line connecting the shooter's shoulders;
6) Place a shoulder against the shoulder rest 16 attached to the rear support 2;
7) Place both hands on the firearm R in a comfortable shooting position;
8) Pull the buttstock 6 of the firearm R towards the shoulder so as to make contact with the inside surface 15 of the rear support 2;
9) Fire or discharge the firearm R;
10) Discharge of the firearm R will cause the firearm to translate linearly, or recoil, in a rearward direction;
11) With the recoiling firearm R in firm contact with the rear support 2, the recoil energy of the firearm is transferred to the shooting rest 1;
12) The shooting rest 1 translates linearly, or recoils, in a rearward direction. Due to the resistance offered by the weights 8 added to the shooting rest, the shooting rest will recoil with a significantly reduced velocity and energy than the firearm alone; and
13) With the shooter in firm contact with the shooting rest 1 the shooter's upper body will in turn absorb the reduced recoil energy of the shooting rest.

With respect to the embodiment of the shooting rest 1 described above, various changes could be made in the above construction. For example, the frame 4 may comprise materials other than steel tubing. Also, the holder 5 may be an integral part of the frame 4 or the holder may be eliminated so that the weights 8 are supported directly on the frame. Further, the weights 8 could be separate components attached to the frame 4 or the weights may be integral with the frame so that the weight of the shooting rest 1 is increased and the recoil energy transferred to a shooter is decreased.

C. Additional Embodiments of Shooting Rests

Figure 6:
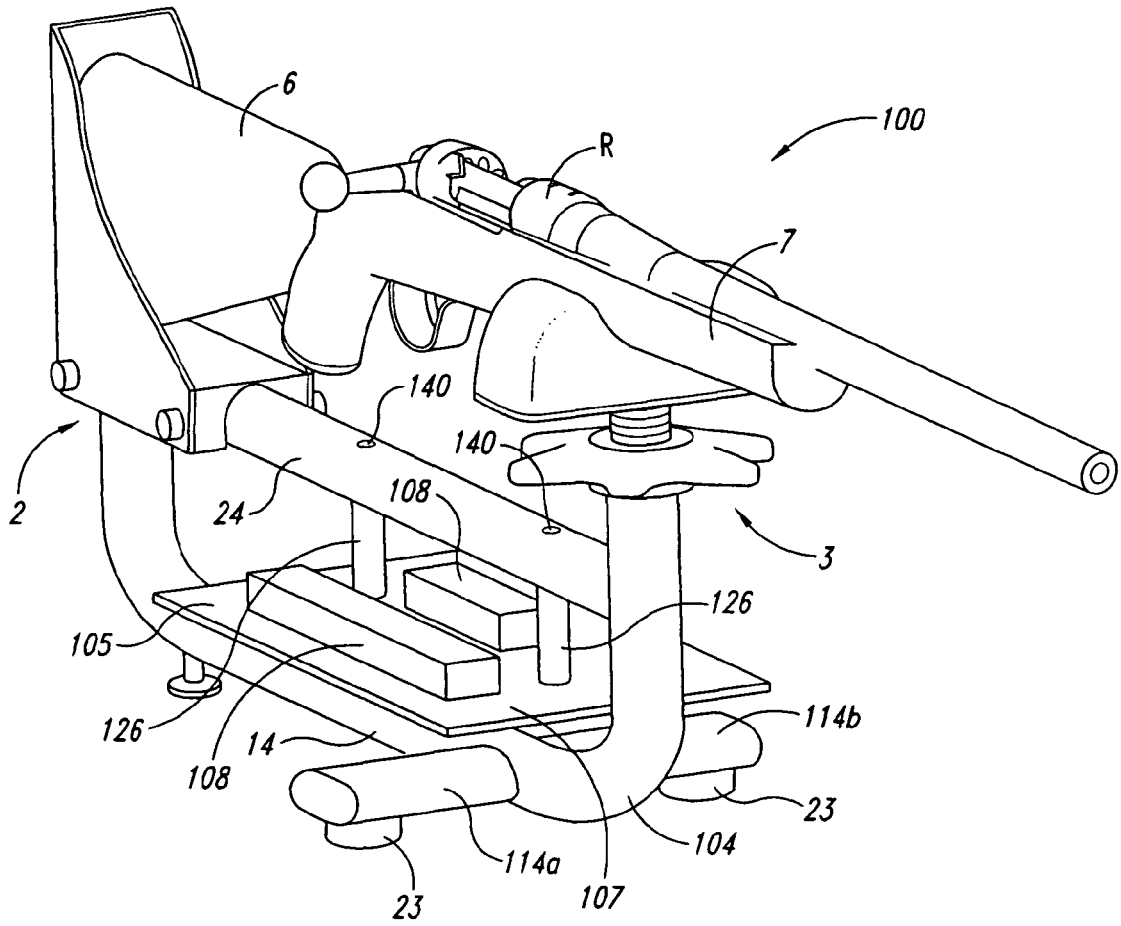
FIG. 6 is a front isometric view of a shooting rest in accordance with another embodiment of the invention.

FIG. 6 is a front isometric view of a shooting rest 100 in accordance with another embodiment of the invention. The shooting rest 100 is generally similar to the shooting rest 1 described above with reference to FIGS. 1-5. For example, the shooting rest 100 includes a rear support 2 for carrying the buttstock 6 of the firearm R, a front support 3 for carrying the forend 7 of the firearm R, and a frame 104 for connecting the rear and front supports 2 and 3. The illustrated frame 104, however, does not include a support member attached to the first horizontal section 14. Rather, the frame 104 includes two legs 114 (identified individually as 114*a-b*) projecting from the first horizontal section 14 and two front feet 23 attached to corresponding legs 114. The legs 114 and the front feet 23 provide stability to the shooting rest 100. In other embodiments, the rear and/or front support 2 and/or 3 can have a different configuration. For example, the rear and/or front support 2 and/or 3 can have a clamping mechanism that selectively grasps or clamps the firearm R to inhibit rearward movement of the firearm R during discharge. In one such embodiment, the clamping mechanism can include two clamping members that selectively move toward each other and exert opposing forces on the firearm R to selectively secure the firearm R in a desired position for discharge.

The illustrated shooting rest 100 further includes a support member 105 attached to the second horizontal section 24 with a plurality of connectors 126. The illustrated support member 105 is a tray or plate having an upper surface 107 for supporting a plurality of removable weights 108. The weights 108 may rest on the surface 107 detached from the support member 105 or the weights 108 can be attached to the support member 105 with straps, Velcro®, or other fasteners. Although the illustrated support member 105 is a generally flat member, in other embodiments the support member may include one or more lips, recesses, protrusions, and/or other features for retaining the weights 108 on the support member 105 during discharge of the firearm R. For example, the support member 105 can be a tray, basket, or rack for carrying the removable weights 108. In additional embodiments, the support member 105 may not be positioned between the first and second horizontal sections 14 and 24, but rather the support member 105 can be positioned between the second horizontal section 24 and the firearm R. Alternatively, in other embodiments, the support member 105 can be attached to the first horizontal section 14 in lieu of the second horizontal section 24.

The connectors 126 couple the support member 105 to the second horizontal section 24. The illustrated connectors 126 are discrete and separate members that are attached to the second horizontal section 24 and the support member 105 with a plurality of fasteners 140 (e.g., screws, bolts, or pins). In other embodiments, the connectors 126 can be an integral part of the support member 105 or the frame 104. The connectors 126 can be flexible members or rigid members (e.g., sections of steel tubing). For example, the connectors 126 can include a strap, rope, cord, belt, and/or other suitable flexible member for coupling the support member 105 to the frame 104. In additional embodiments, the shooting rest 100 may not include the connectors 126. For example, the support member 105 may be a flexible member (e.g., a strap, rope, cord, or belt) configured to wrap around the second horizontal section 24 and support one or more weights. In one such embodiment, the weight may include a through hole through which the flexible support member is received to removably couple the weight to the frame.

Figure 7:
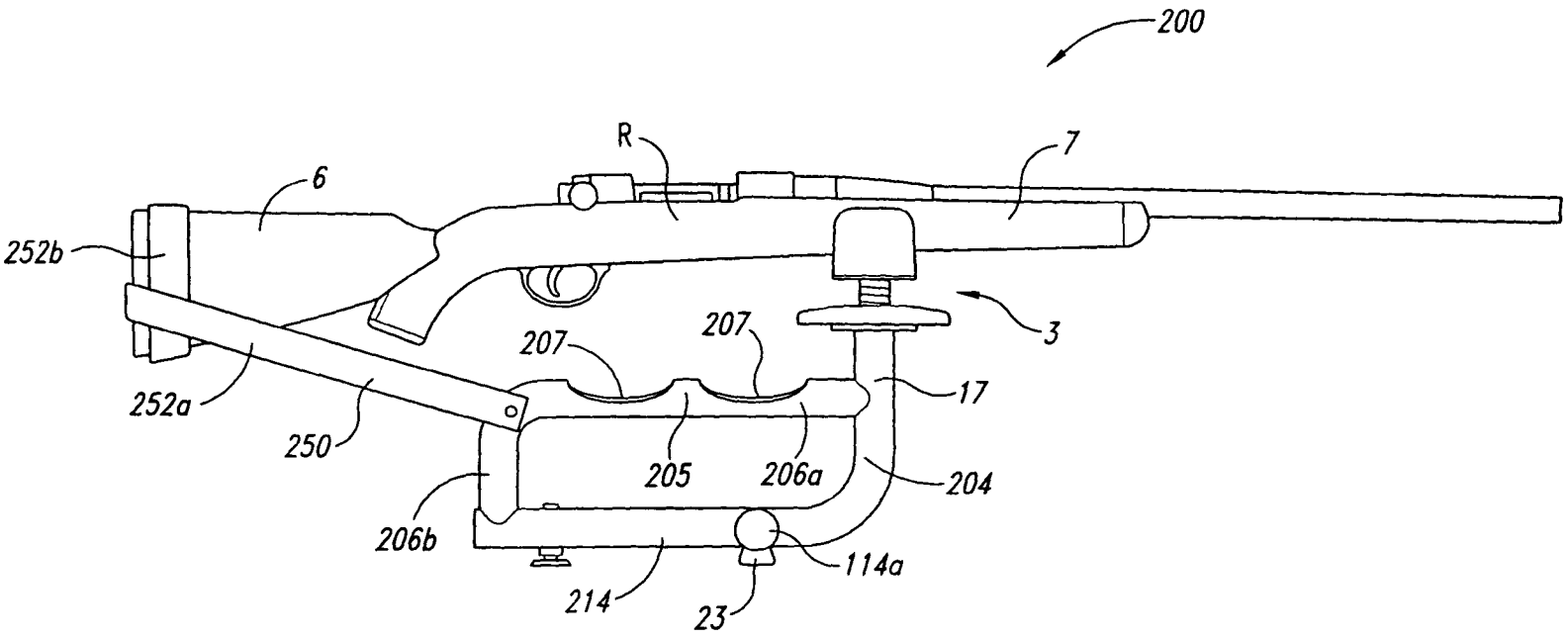
FIG. 7 is a side elevation view of a shooting rest in accordance with another embodiment of the invention.

FIG. 7 is a side elevational view of a shooting rest 200 in accordance with another embodiment of the invention. The shooting rest 200 is generally similar to the shooting rest 100 described above with reference FIG. 6. For example, the shooting rest 200 includes a front support 3 for carrying the forend 7 of the firearm R, a frame 204 for supporting the front support 3, and a support member 205 for carrying one or more removable weights (not shown). The illustrated frame 204 includes a front vertical section 17 attached to the front support 3 and a horizontal section 214 projecting from the front vertical section 17 opposite the front support 3. The illustrated support member 205 includes a horizontal portion 206*a* attached to the vertical section 17 of the frame 204 and a vertical portion 206*b* attached to the horizontal section 214 of the frame 204. The horizontal portion 206*a* has a plurality of recessed surfaces 207 for supporting removable weights during discharge. The contour of the individual recessed surfaces 207 can correspond to the contour of the weights, and the recessed surfaces 207 can be sized and configured to retain the weights during discharge. For example, the width of the horizontal portion 206*a* at the recessed surfaces 207 can be greater than the width of the horizontal portion 206*a* at other sections. In other embodiments, the support member 205 can have a different configuration for carrying one or more removable weights. For example, the support member 205 can include a plurality of protrusions, bosses, hooks, wings, and/or other devices for interfacing with the weights.

The illustrated shooting rest 200 further includes a flexible member 250 for inhibiting rearward movement of the firearm R during discharge. The illustrated flexible member 250 includes a first portion 252*a* extending between the support member 205 and the buttstock 6 of the firearm R and a second portion 252*b* extending around the buttstock 6 in a direction generally transverse to the first portion 252*a*. The flexible member 250 can be a strap, cord, belt, or other flexible member that is selectively attached to the buttstock 6 of the firearm R. In other embodiments, the flexible member 250 can have a different configuration. For example, the flexible member 250 can include a pocket into which at least a portion of the buttstock 6 of the firearm R can be received. In either case, the flexible member 250 inhibits rearward movement of the firearm R during discharge. Although the illustrated shooting rest 200 does not include a rear support for carrying the buttstock 6 of the firearm R, in other embodiments the shooting rest may include a rear support.

Figure 8:
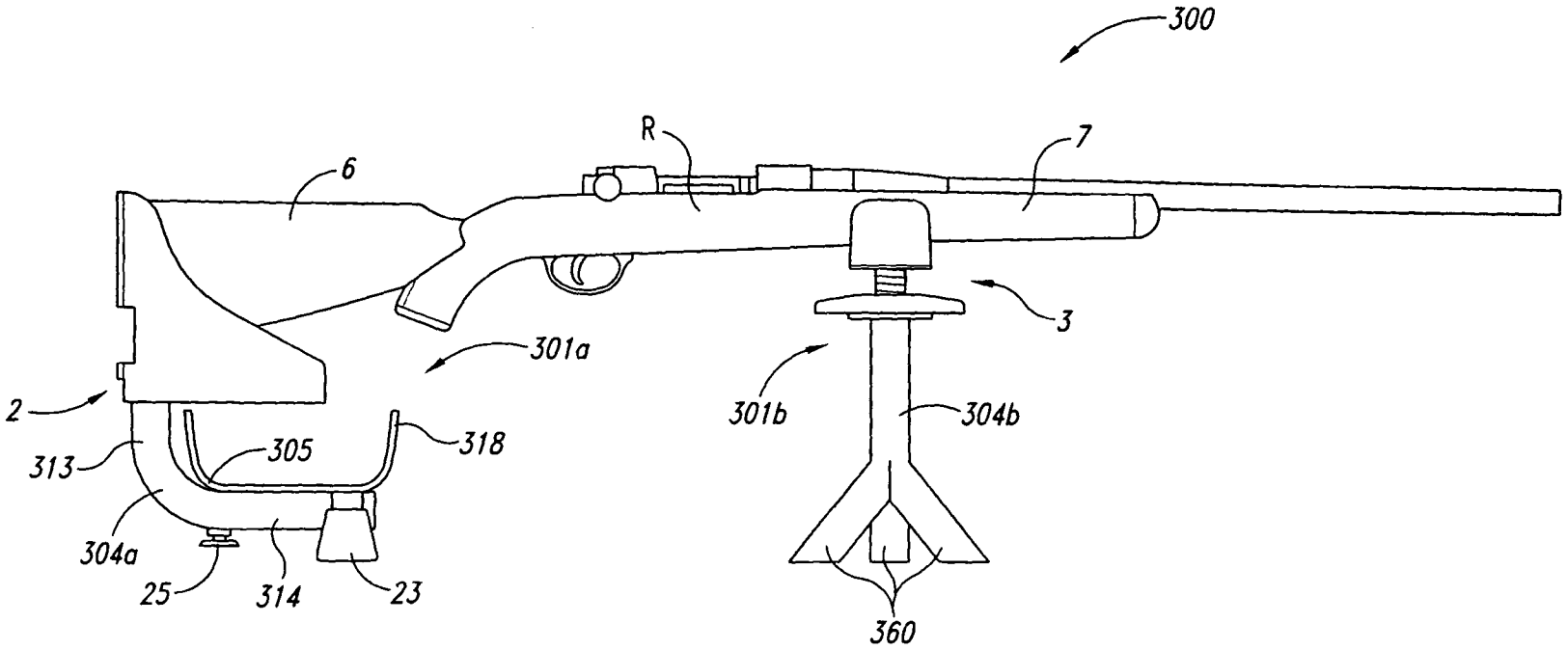
FIG. 8 is a side elevation view of a shooting rest in accordance with another embodiment of the invention.

FIG. 8 is a side elevational view of a shooting rest 300 in accordance with another embodiment of the invention. The illustrated shooting rest 300 includes a rear portion 301*a* and a front portion 301*b* spaced apart and disconnected from the rear portion 301*a*. The rear portion 301*a* includes a rear support 2 for carrying the buttstock 6 of the firearm R, a first frame 304*a* for supporting the rear support 2, and a support member 305 for carrying one or more removable weights. The first frame 304*a* includes a vertical section 313 attached to the rear support 2 and a horizontal section 314 projecting from the vertical section 313 opposite the rear support 2. The support member 305 is attached to the horizontal section 314 and positioned so that a shooter can place one or more weights on the support member 305. The support member 305 can be a tray, plate, basket, or other suitable member for carrying the weights. The illustrated support member 305 is a plate having upward extending ends 318 to prevent the weights from falling off the support member 305 during discharge. The rear portion 301*a* may further include one or more front feet 23 attached to the support member 305 and a rear foot 25 attached to the first frame 304*a* for increasing stability.

The front portion 301*b* of the shooting rest 300 includes a front support 3 for carrying the forend 7 of the firearm R and a second frame 304*b* for supporting the front support 3. The second frame 304*b* includes a plurality of legs 360 for providing stability to the front portion 301*b*. In additional embodiments, the front support 3 can include a clamping device to inhibit rearward movement of the firearm R during discharge, and/or the front portion 301*b* may include the support member 305. In other embodiments, the shooting rest 300 may not include the rear or front portion 301*a* or 301*b*.

Figure 9:
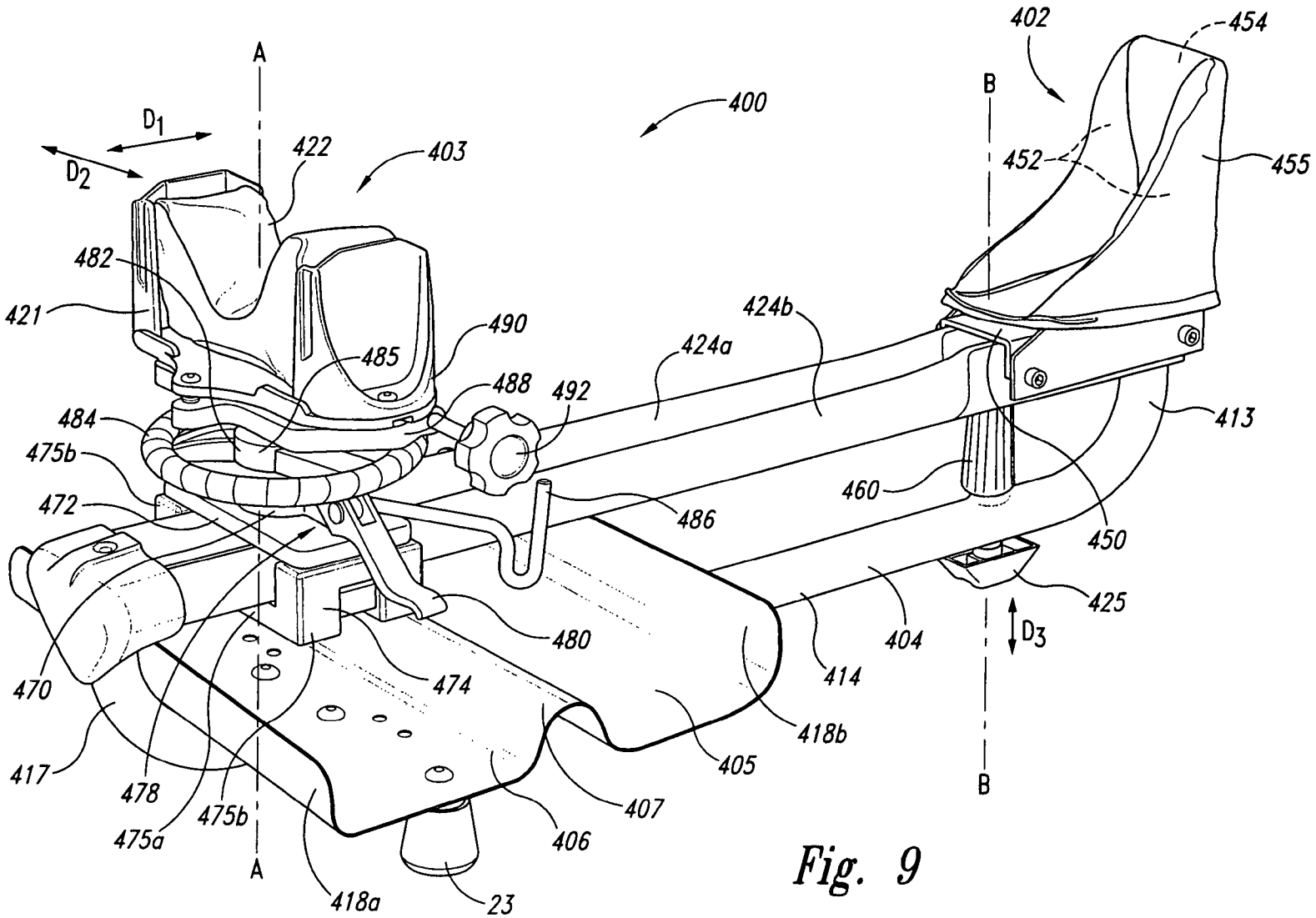
FIG. 9 is a front isometric view of a shooting rest in accordance with another embodiment of the invention.

FIG. 9 is a front isometric view of a shooting rest 400 in accordance with another embodiment of the invention. The illustrated shooting rest 400 is generally similar to the shooting rest 100 described above with reference to FIG. 6. For example, the illustrated shooting rest 400 includes a rear support 402 for carrying a rear portion of a firearm, a front support 403 for carrying a forward portion of the firearm, a frame 404 extending between the rear and front supports 402 and 403, and a support member 405 for carrying one or more removable weights. The illustrated frame 404 includes a rear vertical section 413 attached to the rear support 402, a lower horizontal section 414 projecting from the rear vertical section 413, a front vertical section 417 projecting from the lower horizontal section 414, and first and second upper horizontal sections 424*a-b* extending between the front vertical section 417 and the rear vertical section 413. In the illustrated embodiment, the rear vertical section 413, the lower horizontal portion 414, the front vertical section 417 are integral sections of a single member, and the first and second upper horizontal sections 424*a-b* are separate members attached to the rear and front vertical sections 413 and 417. In other embodiments, however, the frame 404 can have a different configuration.

The illustrated rear support 402 includes a horizontal wall 450, two side walls 452 projecting upward from the horizontal wall 450, and a vertical wall 454 projecting upward from the horizontal wall 450 and extending between the two side walls 452. The horizontal, side, and vertical walls 450, 452, and 454 define a pocket sized to receive an aft portion of a firearm. The horizontal, side, and/or vertical wall 450, 452, and/or 454 can be rigid panels. As such, the horizontal wall 450 is positioned to support the weight of the aft portion of the firearm; the side walls 452 are positioned to prevent the aft portion of the firearm from sliding off the horizontal wall 450; and the vertical wall 454 is positioned to inhibit rearward movement of the firearm during discharge. In the illustrated embodiment, the rear support 402 further includes a sleeve 455 placed over the horizontal, side, and vertical walls 450, 452, and 454. In other embodiments, the rear support 402 can have a different configuration.

The illustrated front support 403 includes a base 470, a cradle 421 carried by the base 470, and a bag 422 carried by the cradle 421. The illustrated base 470 includes a plate 472 and a securing member 474 attached to the plate 472. The plate 472 is positioned over the first and second upper horizontal sections 424*a-b*. The securing member 474 includes a first portion 475*a* positioned under the first and second upper horizontal sections 424*a-b* and end portions 475*b* projecting from the first portion 475*a* toward the plate 472. The plate 472 and the securing member 474 connect the front support 403 to the first and second upper horizontal sections 424*a-b* such that the front support 403 can slide along the upper horizontal sections 424 in a direction $D_1$. As a result, the distance between the front support 403 and the rear support 402 can be changed to accommodate firearms with different lengths and/or configurations. In additional embodiments, the front support 403 may not be slidably coupled to the first and second upper horizontal sections 424*a-b*.

The base 470 may also include a first locking mechanism 478 (only a portion of which is shown in FIG. 9) for selectively inhibiting movement of the base 470 along the first and second upper horizontal sections 424*a-b* in the direction $D_1$. The first locking mechanism 478 may include a stop or other device for contacting the first and/or second upper horizontal sections 424*a-b* to inhibit relative movement between the base 470 and the upper horizontal sections 424. The illustrated first locking mechanism includes a handle 480 configured such that a shooter can pivot the handle (a) downward to selectively lock the base 470 in a specific position, and (b) upward to enable the base 470 to move in the direction $D_1$.

The illustrated base 470 further includes a height adjustment mechanism 482 for adjusting the elevation of the cradle 421 and the vertical aim of the firearm. The height adjustment mechanism 482 includes a handle 484 and a hub 485 with a threaded hole (not shown) operably coupled to the handle 484. The threaded hole is positioned to interact with a threaded shaft (not shown) of the cradle 421. As such, a shooter can rotate the handle 484 to pivot the hub 485 about an axis A-A, which drives the threaded shaft and cradle 421 upward or downward along the axis A-A. The base 470 may also include a second locking mechanism (only a portion of which is shown in FIG. 9) for inhibiting vertical movement of the cradle 421 along the axis A-A. The illustrated second locking mechanism includes a handle 486 for enabling a shooter to lock the cradle 421 in a specific position at a particular elevation. In other embodiments, the cradle 421 may not be movable along the axis A-A.

The illustrated cradle 421 includes a first portion 488 attached to the base 470, a second portion 490 moveably attached to the first portion 488, and a driving mechanism (only a portion of which is shown in FIG. 9) attached to the first and second portions 488 and 490 for moving the second portion 490 relative to the first portion 488. The driving mechanism includes a handle 492 that allows a shooter to move the second portion 490 laterally in a direction $D_2$ relative to the first portion 488. The driving mechanism accordingly enables a shooter to adjust the position of the second portion 490 and the horizontal aim of the firearm.

The support member 405 in the illustrated embodiment is attached to the lower horizontal section 414 of the frame 404 and configured to carry at least one removable weight. Although the support member 405 is attached to the lower horizontal section 414 proximate to the forward vertical section 417, in other embodiments the support member 405 can be attached to an aft portion of the frame 404. The illustrated support member 405 is a tray having front and rear lips 418*a-b* for preventing the weights from falling off the support member 405 during discharge. The support member 405 may further include a raised portion 407 extending laterally across the support member 405 in a direction generally parallel to the front and rear lips 418*a-b* . The raised portion 407 inhibits the weights from moving on the support member 405 during recoil. In additional embodiments, the support member 405 can have a different configuration. For example, the support member can be a reservoir configured to receive water, sand, lead shot, pellet-like material, and/or other material for adding weight to the shooting rest. In other embodiments, portions of the frame 404 can function as the support member. For example, the frame may include an opening configured to receive water, sand, lead shot, pellet-like material, and/or other material for adding weight to the shooting rest.

The illustrated shooting rest 400 further includes an angle adjustment mechanism 460 attached to the frame 404 and a rear foot 425 attached to the angle adjustment mechanism 460. The angle adjustment mechanism 460 can include a threaded hole; and the rear foot 425 can include a threaded shaft that projects through a hole in the lower horizontal section 414 and is received in the threaded hole of the angle adjustment mechanism 460. As a result, a shooter can pivot the angle adjustment mechanism 460 about an axis B-B to drive the rear foot 425 upward or downward in a direction $D_3$ to adjust the elevation of the frame 404 and the vertical aim of the firearm. In other embodiments, the shooting rest 400 may not include the angle adjustment mechanism 460 and/or the rear foot 425.

Figure 10:
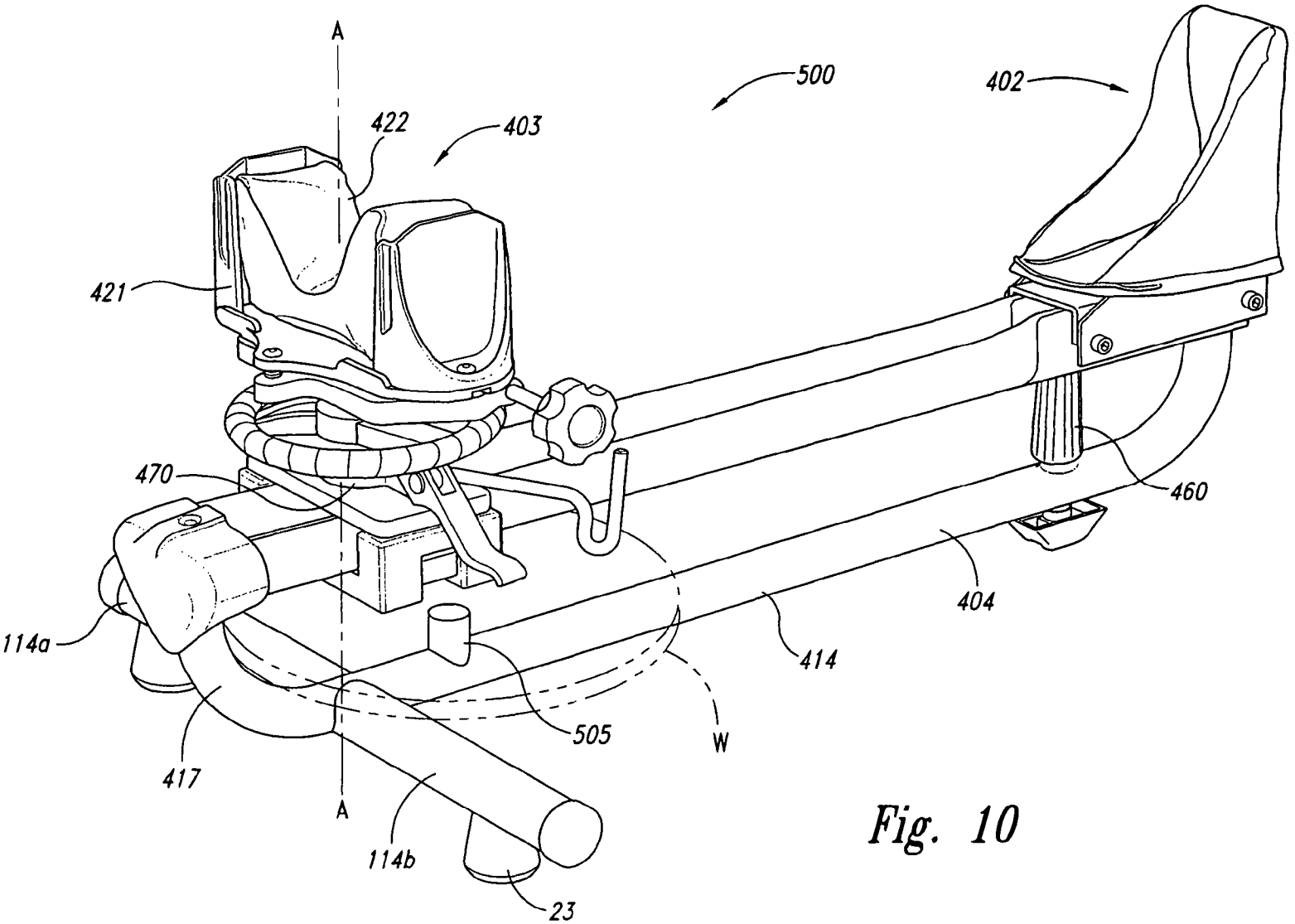
FIG. 10 is a front isometric view of a shooting rest in accordance with another embodiment of the invention.

FIG. 10 is a front isometric view of a shooting rest 500 in accordance with another embodiment of the invention. The illustrated shooting rest 500 is generally similar to the shooting rest 400 described above with reference to FIG. 9. For example, the shooting rest 500 includes a rear support 402, a front support 403, a frame 404 connecting the rear and front supports 402 and 403, and a support member 505 attached to the frame 404. The illustrated support member 505, however, projects from the lower horizontal section 414 of the frame 404 in a direction generally parallel to the axis A-A. The support member 505 can be an integral part of the frame 404 or a separate component attached to the frame 404. The support member 505 is configured to be received within an aperture of a removable weight W (shown in broken lines) to secure the weight W to the frame 404. In other embodiments, the support member 505 may interact with and/or engage a removable weight having a different configuration such that the support member 505 releasably secures the weight W to the frame 404. In additional embodiments, the shooting rest 500 may include multiple support members 505 projecting from the lower horizontal section 414 and/or other portions of the frame 404. For example, in one such embodiment, the support members can project from the legs 114*a-b* of the frame 414 or the legs 114*a-b* can include a section for receiving the weights W.

Figure 11:
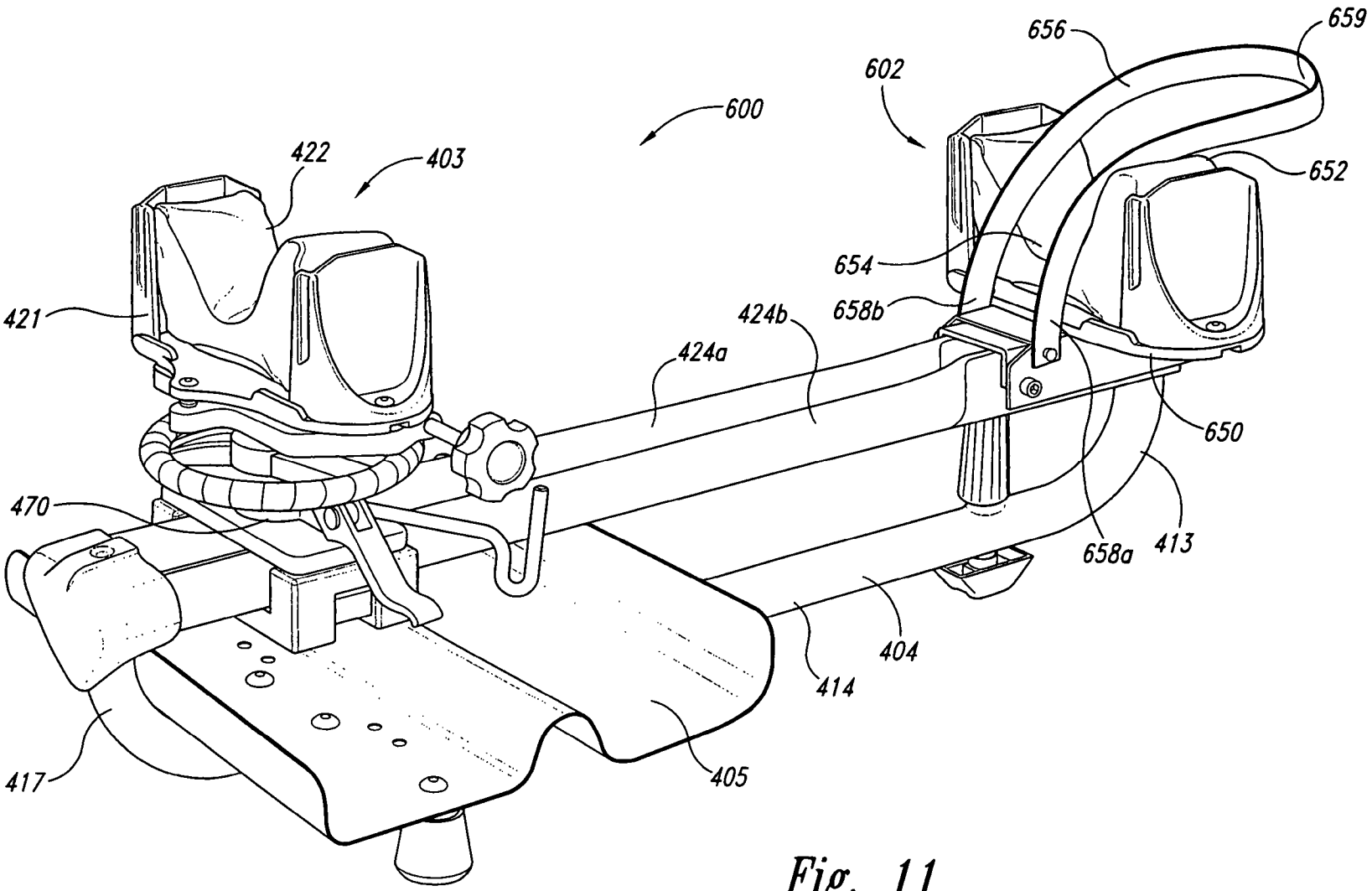
FIG. 11 is a front isometric view of a shooting rest in accordance with another embodiment of the invention.

FIG. 11 is a front isometric view of a shooting rest 600 in accordance with another embodiment of the invention. The illustrated shooting rest 600 is generally similar to the shooting rest 400 described above with reference to FIG. 9. For example, the shooting rest 600 includes a rear support 602, a front support 403, a frame 404 connecting the rear and front supports 602 and 403, and a support member 405 attached to the frame 404. The illustrated rear support 602, however, includes a plate 650 attached to the frame 404, a bag 652 attached to the plate 650, and a strap 656 attached to the plate 650, bag 652, and/or frame 404. The bag 652 can be generally similar to the bag 422 of the front support 403. For example, the bag 652 can have a support surface 654 with a V-shape configuration for supporting the buttstock of a firearm. The strap 656 is configured to wrap around the buttstock of the firearm and inhibit rearward motion of the firearm during discharge. The illustrated strap 656 includes two end portions 658*a-b* attached to the plate 650, bag 652, and/or frame 404 and an intermediate section 659 between the end portions 658*a-b*. The intermediate portion 659 is positioned to contact the butt of the firearm. In other embodiments, the shooting rest 600 may include multiple straps that extend between the frame 404 and the firearm to inhibit movement of the firearm during discharge. For example, the shooting rest 600 may include one or more straps coupled to the swivel stud, scope base, and/or firearm wrist.

From the foregoing, it will be appreciated that specific embodiments of the invention have been described herein for purposes of illustration, but that various modifications may be made without deviating from the spirit and scope of the invention. For example, many of the elements of one embodiment can be combined with other embodiments in addition to or in lieu of the elements of the other embodiments. Accordingly, the invention is not limited except as by the appended claims.

We claim:

1. A shooting rest for supporting a firearm having a first portion and a second portion rearward of the first portion, the shooting rest comprising:

a front support for supporting the first portion of the firearm;

a rear support for supporting the second portion of the firearm;

a frame coupling the front support to the rear support;

the rear support including a stop configured to inhibit rearward movement of the firearm relative to the shooting rest, the stop including a rear panel and two side panels coupled to the rear panel defining a pocket sized and shaped for receiving a butt of the firearm, the rear panel and side panels including respective inner surfaces and respective outer surfaces opposite the inner surfaces, the outer surfaces facing outward away from the pocket, the pocket including a top and a bottom; and a cover for at least partially covering the stop, the cover including an inner portion for receiving the butt of the firearm and an outer portion for engaging a shoulder of a user, the outer portion extending outwardly from the outer surface of the rear panel between the left and right panels adjacent the bottom of the pocket.

2. A shooting rest as set forth in claim 1 wherein the cover has side sections receivable over the side panels and a rear section receivable over the rear panel for covering the rear and side panels.

3. A shooting rest as set forth in claim 2 wherein the cover is configured for covering inside and outside surfaces of the side panels.

4. A shooting rest as set forth in claim 3 wherein the cover extends on the outside surfaces of the side panels adjacent the bottom of the pocket from front ends of the side panels to rear ends of the side panels.

5. A shooting rest as set forth in claim 2 wherein the cover includes panel receiving compartments sized for receiving the side and rear panels.

6. A shooting rest as set forth in claim 2 wherein the cover includes a lower section extending between the side sections in front of the rear section.

7. A shooting rest as set forth in claim 1 wherein the side panels extend forward in front of the rear panel, and, adjacent the bottom of the pocket, the side panels extend farther forward from the rear panel than adjacent the top of the pocket.

8. A shooting rest as set forth in claim 1 wherein the side panels taper in length from a first length adjacent the bottom of the pocket to a second length adjacent the top of the pocket less than the first length.

* * * * *